US007180418B1

(12) United States Patent
Willms et al.

(10) Patent No.: US 7,180,418 B1
(45) Date of Patent: Feb. 20, 2007

(54) ACTIVE THREAT DETECTION AND ELIMINATION WHILE IN TRANSIT

(75) Inventors: Paul H. Willms, Everett, WA (US); James H. Stanley, Palo Alto, CA (US)

(73) Assignee: Erudite Holding LLC, Everett, WA (US)

( * ) Notice: Subject to any disclaimer, the term of this patent is extended or adjusted under 35 U.S.C. 154(b) by 52 days.

(21) Appl. No.: 11/025,447

(22) Filed: Dec. 27, 2004

(51) Int. Cl.
*G08B 13/14* (2006.01)

(52) U.S. Cl. ..... 340/568.1; 340/567; 250/287

(58) Field of Classification Search ..... 340/568.1, 340/539.1, 539.26, 567, 572.1; 250/287; 73/23.41
See application file for complete search history.

(56) References Cited

U.S. PATENT DOCUMENTS 5,585,575 A * 12/1996 Corrigan et al. ..... 73/863.71
5,760,898 A * 6/1998 Haley et al. ..... 356/318
5,912,466 A * 6/1999 Funsten et al. ..... 250/372
6,295,860 B1 * 10/2001 Sakairi et al. ..... 73/23.41
6,610,977 B2 * 8/2003 Megerle ..... 250/287
6,797,944 B2 9/2004 Nguyen et al.
7,002,472 B2 * 2/2006 Stratmoen et al. ..... 340/539.26
2003/0220711 A1 * 11/2003 Allen ..... 700/215
2005/0197844 A1 * 9/2005 Ng et al. ..... 705/1

* cited by examiner

*Primary Examiner*—Phung T. Nguyen
(74) *Attorney, Agent, or Firm*—Boris G. Tankhilevich

(57) ABSTRACT

A method of active detection of at least one threat to the homeland security. Each such threat is either hidden inside at least one cargo container before transit, or is placed inside at least one cargo container while in transit; each such threat while interacting with its surrounding generates a unique threat signature. The method comprises the following steps: (A) substantially continuously probing each cargo container; (B) detecting at least one threat signature; (C) processing each detected threat signature to determine a likelihood of at least one threat to become a threat to the homeland security; (D) identifying at least one container that includes such threat to the homeland security; and (E) eliminating such threat to the homeland security.

5 Claims, 4 Drawing Sheets

ACTIVE THREAT DETECTION AND ELIMINATION WHILE IN TRANSIT

BACKGROUND OF THE INVENTION

1. Field of the Invention

The present invention relates to the field of threat detection and identification, and more specifically, to the field of active detection, identification, and elimination of threats hidden inside cargo shipments wile in transit.

2. Discussion of the Prior Art

Economic Jihad is an another manifestation of the asymmetric war against terror. The attacks of 9/11 had cost the terrorists about $0.5 million, and resulted in a cost to the American Economy of over $1 trillion. That includes over $450 billion in direct costs of the war on terror, and more than 0.5% loss in GDP in the first year, which exceeds $500 billion. This is an asymmetry ratio of 1:2,000,000. For each $1 dollar that the terrorists spent, the U.S. alone spent about $2 million. While it is prudent to pay attention to the direct threat of terrorism on our safety and security, it is also very important to pay attention to the fact that the terrorists and many others in the Moslem world have declared an economic war on the US and its allies, a war which they view as having potentially more destructive impact than the human toll of terror.

One of the pillars of the US economy is a world trade activity. However, guarding against illicit cargo trying to enter the country by land, sea or air using shipping containers is a difficult problem. Each year more than 48 million loaded cargo containers move between the world's seaports. Six million loaded cargo containers arrive in the U.S. each year, but only 5 percent have their content visually inspected or x-rayed, opening the possibility that the terrorists could use them to smuggle in nuclear material, explosives, or even themselves.

SUMMARY OF THE INVENTION

The present invention addresses the difficult problem of guarding against illicit cargo trying to enter the country by sea and presenting the threat to the Homeland Security by using the active detection, identification, and elimination of threats hidden inside cargo shipments while in transit.

One aspect of the present invention is directed to a method of active detection of at least one threat to the homeland security. Each such threat is either hidden inside at least one cargo container before transit, or is placed inside at least one cargo container while in transit. Each such threat while interacting with its surrounding generates a unique threat signature.

In one embodiment, the method of the present invention comprises the following steps: (A) substantially continuously probing each cargo container; (B) detecting at least one threat signature; (C) processing each detected threat signature to determine a likelihood of at least one threat to become a threat to the homeland security; (D) identifying at least one container that includes at least one threat to the homeland security; and (E) eliminating at least one threat to the homeland security while in transit.

In one embodiment of the present invention, wherein at least one container is equipped with at least one active electromagnetic sensor, the step (A) further comprises the step (A1) of using each active electromagnetic sensor to substantially continuously probe at least one cargo container by generating a 2-D internal probing signal, wherein at least one response signal is indicative of at least one threat signature. In another embodiment of the present invention, wherein at least one container is equipped with at least one active electromagnetic sensor, the step (A) further comprises the step (A2) of using each active electromagnetic sensor to substantially continuously probe at least one cargo container by generating a 3-D internal probing signal, wherein at least one response signal is indicative of at least one threat signature.

In one embodiment of the present invention, wherein each container is selected from the group consisting of: {a container equipped with at least one active electromagnetic sensor; and a "rogue" container that is not equipped with at least one active electromagnetic sensor}, the step (A) further comprises the step (A3) of using each active electromagnetic sensor to substantially continuously probe at least one cargo container by generating a 2-D external probing signal, wherein at least one response signal is indicative of at least one threat signature. In another embodiment of the present invention, wherein each container is selected from the group consisting of: {a container equipped with at least one active electromagnetic sensor; and a "rogue" container that is not equipped with at least one active electromagnetic sensor}, the step (A) further comprises the step (A4) of using each active electromagnetic sensor to substantially continuously probe at least one cargo container by generating a 3-D external probing signal, wherein at least one response signal is indicative of at least one threat signature.

In one embodiment of the present invention, wherein the cargo ship is equipped with a grid/array of electromagnetic sensor pads, the step (A) further comprises the step (A5) of using the grid/array of electromagnetic sensor pads to substantially continuously probe at least one cargo container, wherein at least one response signal is indicative of at least one threat signature.

In one embodiment of the present invention, the step (A5) further comprises the step (A5, 1) of using the grid/array of electromagnetic sensor pads to substantially continuously ping each cargo container, wherein at least one response signal is indicative of at least one threat signature. In another embodiment of the present invention, the step (A5) further comprises the step (A5, 2) of using the grid/array of electromagnetic sensor pads to form an electromagnetic beam signal, wherein the electromagnetic beam signal is used to ping at least one cargo container, and wherein at least one response signal is indicative of at least one threat signature.

In one embodiment of the present invention, wherein at least one container is equipped with at least one active acoustic sensor, the step (A) further comprises the step (A6) of using each active acoustic sensor to substantially continuously probe at least one cargo container by generating a 2-D internal acoustic probing signal, wherein at least one response signal is indicative of at least one threat signature. In another embodiment of the present invention, wherein at least one container is equipped with at least one active acoustic sensor, the step (A) further comprises the step (A7) of using each active acoustic sensor to substantially continuously probe at least one cargo container by generating a 3-D internal acoustic probing signal, wherein at least one response signal is indicative of at least one threat signature.

In one embodiment of the present invention, wherein each container is selected from the group consisting of: {a container equipped with at least one active acoustic sensor; and a "rogue" container that is not equipped with at least one active acoustic sensor}, the step (A) further comprises the step (A8) of using each active acoustic sensor to substantially continuously probe at least one cargo container by generating a 2-D external acoustic probing signal, wherein at least one response signal is indicative of at least one threat signature. In another embodiment of the present invention, wherein each container is selected from the group consisting of: {a container equipped with at least one active acoustic sensor; and a "rogue" container that is not equipped with at least one active acoustic sensor}, the step (A) further comprises the step (A9) of using each active acoustic sensor to substantially continuously probe at least one cargo container by generating a 3-D external acoustic probing signal, wherein at least one response signal is indicative of at least one threat signature.

In one embodiment of the present invention, wherein the cargo ship is equipped with a grid/array of acoustic sensor pads, the step (A) further comprises the step (A10) of using the grid/array of acoustic sensor pads to substantially continuously probe at least one cargo container, wherein at least one response signal is indicative of at least one threat signature.

In one embodiment of the present invention, the step (A10) further comprises the step (A10, 1) of using the grid/array of acoustic sensor pads to substantially continuously ping each cargo container, wherein at least one response signal is indicative of at least one threat signature. In another embodiment of the present invention, the step (A10) further comprises the step (A10, 2) of using the grid/array of acoustic sensor pads to form an acoustic beam signal, wherein the narrowly formed acoustic beam signal is used to ping at least one cargo container, and wherein at least one response signal is indicative of at least one threat signature.

In one embodiment of the present invention, the step (A) further comprises the step (A11) of using a radio sensor to detect an RF signal emanating from at least one container, wherein each emanated RF signal is selected from the group consisting of: {a cell phone signal; a radio signal; and a pseudolite signal}. In another embodiment of the present invention, the step (A) further comprises the step (A11) of using a radio sensor to detect at least one RF signal incoming into at least one container; wherein each incoming RF signal is selected from the group consisting of: {a cell phone signal; a radio signal; a satellite signal; and a pseudolite signal}.

In one embodiment of the present invention, the step (B) of detecting at least one threat signature further comprises the step (B1) of detecting each threat signature by analyzing at least one response signal.

In one embodiment of the present invention, the step (C) of processing each detected threat signature further comprises the following steps: (C1) selecting an array of statistically significant threat signatures; and (C2) substantially continuously processing the array of selected statistically significant detected threat signatures in order to determine the likelihood of each threat.

In one embodiment of the present invention, the step (D) further comprises the step (D1) of using a radio FREQUENCY identification (RFID) tag to identify at least one container that includes at least one threat to the homeland security.

In one embodiment of the present invention, the step (D) further comprises the step (D2) of using a passive radio FREQUENCY identification (RFID) tag to identify at least one container that includes at least one threat to the homeland security.

In one embodiment of the present invention, the step (E) further comprises the step (E1) of launching an emergency beacon to alert maritime traffic of the hazard to navigation.

In one embodiment of the present invention, the step (E) further comprises the step (E2) of using robotic means to eliminate at least one detected threat to the homeland security.

In one embodiment of the present invention, the step (E) further comprises the step (E3) of using a jamming device to suppress an RF signal emanating from or incoming to at least one container, wherein the RF signal is selected from the group consisting of: {a radio signal; a cell phone signal; a satellite signal; and a pseudolite signal}.

Another aspect of the present invention is directed to an apparatus for active detection of at least one threat to the homeland security.

In one embodiment, the apparatus of the present invention comprises: (A) a means for substantially continuously probing each cargo container; (B) a means for detecting at least one threat signature; (C) a means for processing each detected threat signature to determine a likelihood of at least one threat to become a threat to the homeland security; (D) a means for identifying at least one container that includes the threat to the homeland security; and (E) a means for eliminating at least one threat to the homeland security.

In one embodiment of the present invention, the means (A) for substantially continuously probing each cargo container further comprises an active 2-D electromagnetic sensor placed inside at least one container. In this embodiment of the present invention, the active 2-D electromagnetic sensor is configured to substantially continuously probe at least one cargo container by generating a 2-D internal probing signal, wherein at least one response signal is indicative of at least one threat signature.

In one embodiment of the present invention, the means (A) for substantially continuously probing each cargo container further comprises an active 3-D electromagnetic sensor placed inside at least one container. In this embodiment of the present invention, the active 3-D electromagnetic sensor is configured to substantially continuously probe at least one cargo container by generating a 3-D internal probing signal, wherein at least one response signal is indicative of at least one threat signature.

In one embodiment of the present invention, the means (A) for substantially continuously probing each cargo container further comprises an active 2-D electromagnetic sensor placed outside at least one container. In this embodiment of the present invention, the active 2-D electromagnetic sensor is configured to substantially continuously probe at least one cargo container by generating a 2-D external probing signal, wherein least one response signal is indicative of at least one threat signature.

In one embodiment of the present invention, the means (A) for substantially continuously probing each cargo container further comprises an active 3-D electromagnetic sensor placed outside at least one container. In this embodiment of the present invention, the active 3-D electromagnetic sensor is configured to substantially continuously probe at least one cargo container by generating a 3-D external probing signal, wherein at least one response signal is indicative of at least one threat signature.

In one embodiment of the present invention, the means (A) for substantially continuously probing each cargo container further comprises a grid/array of electromagnetic sensor pads placed inside the cargo ship. In this embodiment of the present invention, the grid/array of electromagnetic sensor pads is configured to substantially continuously probe at least one cargo container, wherein at least one response signal is indicative of at least one threat signature.

In one embodiment of the present invention, the means (A) for substantially continuously probing each cargo container further comprises a beam-forming grid/array of electromagnetic sensor pads placed inside the cargo ship. In this embodiment of the present invention, the beam-forming grid/array of electromagnetic sensor pads is configured to form an electromagnetic beam signal, wherein the electromagnetic beam signal is used to ping at least one cargo container, and wherein at least one response signal is indicative of at least one threat signature.

In one embodiment of the present invention, the means (A) for substantially continuously probing each cargo container further comprises an active 2-D acoustic sensor placed inside at least one container. In this embodiment of the present invention, the active 2-D acoustic sensor is configured to substantially continuously probe at least one cargo container by generating a 2-D internal acoustic probing signal, wherein at least one response signal is indicative of at least one threat signature.

In one embodiment of the present invention, the means (A) for substantially continuously probing each cargo container further comprises an active 3-D acoustic sensor placed inside at least one container. In this embodiment of the present invention, the active 3-D acoustic sensor is configured to substantially continuously probe at least one cargo container by generating a 3-D internal acoustic probing signal, wherein at least one response signal is indicative of at least one threat signature.

In one embodiment of the present invention, the means (A) for substantially continuously probing each cargo container further comprises an active 2-D acoustic sensor placed outside at least one container. In this embodiment of the present invention, the active 2-D acoustic sensor is configured to substantially continuously probe at least one cargo container by generating a 2-D external acoustic probing signal, wherein at least one response signal is indicative of at least one threat signature.

In one embodiment of the present invention, the means (A) for substantially continuously probing each cargo container further comprises an active 3-D acoustic sensor placed outside at least one container. In this embodiment of the present invention, the active 3-D acoustic sensor is configured to substantially continuously probe at least one cargo container by generating a 3-D external acoustic probing signal, wherein at least one response signal is indicative of at least one threat signature.

In one embodiment of the present invention, the means (A) for substantially continuously probing each cargo container further comprises a grid/array of acoustic sensor pads placed inside the cargo ship. In this embodiment of the present invention, the grid/array of acoustic sensor pads is configured to substantially continuously probe at least one cargo container, wherein at least one response signal is indicative of at least one threat signature.

In one embodiment of the present invention, the means (A) for substantially continuously probing each cargo container further comprises a beam-forming grid/array of acoustic sensor pads placed inside the cargo ship. In this embodiment of the present invention, the beam-forming grid/array of acoustic sensor pads is configured to form an acoustic beam signal, wherein the acoustic beam signal is used to ping at least one cargo container, and wherein at least one response signal is indicative of at least one threat signature.

In one embodiment of the present invention, the means (A) for substantially continuously probing each cargo container further comprises an internal radio sensor configured to detect an RF signal emanating from at least one container, wherein an emanated RF signal is selected from the group consisting of: {a cell phone signal; a radio signal; and a pseudolite signal}.

In one embodiment of the present invention, the means (A) for substantially continuously probing each cargo container further comprises an external radio sensor configured to detect at least one RF signal incoming into at least one container, wherein an incoming RF signal is selected from the group consisting of: {a cell phone signal; a radio signal; a satellite signal; and a pseudolite signal}.

In one embodiment of the present invention, the means (B) for detecting at least one threat signature further comprises a means for analyzing at least one response signal.

In one embodiment of the present invention, the means (C) for processing each detected threat signature to determine a likelihood of at least one threat to become a threat to the homeland security further comprises: (C1) a means for selecting an array of statistically significant threat signatures, and (C2) a means for substantially continuously processing the array of selected statistically significant detected threat signatures in order to determine the likelihood of each threat.

In one embodiment of the present invention, the means (C1) for selecting the array of statistically significant detected threat signatures further comprises: (C1, 1) a means for measuring a background threat signature distribution in a threat-free environment; (C1, 2) a means for comparing each detected threat signature signal with the background threat signature distribution; and (C1, 3) a means for selecting the detected threat signature to be a part of the array of the statistically significant detected threat signatures, if deviation of each selected threat signature signal from the background threat signature distribution is statistically significant.

In one embodiment of the present invention, the means (C2) for substantially continuously processing the array of the selected statistically significant threat signatures in order to determine the likelihood of each threat further comprises: (C2, 1) a means for generating a statistically significant threat signal corresponding to each detected threat signature having the statistically significant deviation from the background threat signature distribution; (C2, 2) a means for consulting a database of predetermined thresholds associated with a plurality of known threat signatures; (C2, 3) a means for comparing each statistically significant threat signature signal with at least one predetermined threshold associated with the plurality of known threat signatures; (C2, 4) a means for selecting each statistically significant threat signature signal that exceeds at least one predetermined threshold associated with the plurality of known threat signatures into an N-array of threat signatures; and (C2, 5) a means for determining the likelihood of each threat generating at least one statistically significant threat signature signal exceeding at least one predetermined threshold.

In one embodiment of the present invention, the means (D) for identifying at least one threat to the homeland security further comprises a radio FREQUENCY identification (RFID) tag configured to identify at least one container that includes at least one threat to the homeland security. In another embodiment of the present invention, the means (D) for identifying at least one threat to the homeland security further comprises a passive radio FREQUENCY identification (RFID) tag configured to identify at least one container that includes at least one threat to the homeland security.

In one embodiment of the present invention, the means (E) for eliminating at least one threat to the homeland security further comprises an emergency beacon configured to alert maritime traffic of the hazard to navigation.

In one embodiment of the present invention, the means (E) for eliminating at least one threat to the homeland security further comprises a robotic means configured to eliminate at least one detected threat to the homeland security.

In one embodiment of the present invention, the means (E) for eliminating at least one threat to the homeland security further comprises a jamming device configured to suppress an RF signal emanating from or incoming into at least one container, wherein the RF signal is selected from the group consisting of: {a radio signal; a cell phone signal; a satellite signal; and a pseudolite signal}.

BRIEF DESCRIPTION OF DRAWINGS

The aforementioned advantages of the present invention as well as additional advantages thereof will be more clearly understood hereinafter as a result of a detailed description of a preferred embodiment of the invention when taken in conjunction with the following drawings.

DETAILED DESCRIPTION OF THE PREFERRED AND ALTERNATIVE EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
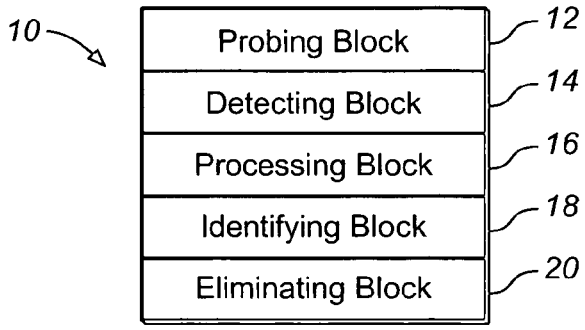
FIG. 1 depicts a functional diagram of the apparatus of the present invention comprising: (A) a block for substantially continuously probing each cargo container; (B) a block for detecting at least one threat signature; (C) a block for processing each detected threat signature to determine a likelihood of at least one threat to become a threat to the homeland security; (D) a block for identifying at least one container that includes the threat to the homeland security; and (E) a block for eliminating at least one threat to the homeland security.

In one embodiment, FIG. 1 illustrates a functional diagram 10 of the apparatus of the present invention comprising: (A) a block 12 for substantially continuously probing each cargo container; (B) a 14 block for detecting at least one threat signature; (C) a block 16 for processing each detected threat signature to determine a likelihood of at least one threat to become a threat to the homeland security; (D) a block 18 for identifying at least one container that includes the threat to the homeland security; and (E) a block 20 for eliminating at least one threat to the homeland security.

As defined herein, threats are items that are not included on the manifest, because the security system was compromised at some point prior to sealing the container. While this is a necessary condition, it is not a sufficient one for illicit contents to be classified as a threat. To be a threat, undeclared cargo should also represent a significant hazard to the homeland. A package of cocaine would constitute illegal cargo but not a security threat.

It is assumed that each threat is either hidden inside at least one cargo container before transit, or is placed inside at least one cargo container while in transit. It is also assumed that each threat while interacting with its surrounding generates a unique threat signature.

Indeed, a threat hidden inside a cargo container should of necessity interact with its environment. These interactions will be collectively referred to here as signatures. By detecting these interactions, it is possible to identify a threat. Please, see full discussion below. The same argument applies to protecting the integrity of a container. All attempts to insert something into a sealed cargo container should of necessity interact with the container.

Like highway trailers, containers come in many variations. The configurations include simple boxes with end door only and no insulation; insulated; insulated and equipped with temperature regulating equipment (heating/cooling). Temperature control equipment can be internally or externally mounted and use either on-board or external energy sources. Some special-purpose containers have side as well as end doors. It is also possible for containers to have top doors/hatches. Some containers have adjustable vents for air circulation, but without any mechanical heating/cooling equipment.

There are two special variations of containers: a tank container and a flat rack. The tank container comprises a cylindrical tank mounted within a rectangular steel framework and includes standard container dimensions (usually 20 or 28 ft). These tanks are intended for use for either liquids or bulk materials. (Because of the weight of liquids and most bulk cargoes, larger sizes are not used for tank containers.)

Flat racks are open-sided platforms, usually with end bulkheads, with the same footprint as basic containers. A collapsible flat rack is one where the end bulkheads can be folded down when the flat rack is stored or shipped empty. Flat racks are used for heavy machinery and are typically carried below decks on ocean legs of their movement. Containers that are described as 20 ft are normally actually 19 ft 11 in. This simplifies getting two 20 ft containers into the same space as a 40 ft container. There are similar variations in the actual sizes of many other types of containers. The quoted sizes are "nominal" sizes.

The framework of containers is normally steel. The exterior sheathing may be either steel or aluminum. Interior sheathing may consist of plywood or composite materials. In 1995 testing began for containers made of space-age composites. Though more expensive than metal-sheathed containers, the composite-sided containers are lighter and are expected to have a longer useful life than metal containers.

The use of large container ships capable of carrying large numbers of containers and being loaded and unloaded quickly at special container ports has drastically changed the movement of ocean cargo over a relatively short time. Though most container traffic is on the super container ships between major ports, even most smaller vessels now have provisions for carrying some containers on deck.

On the larger container vessels, the containers are located above the deck, as well as below the deck. The container cranes used in major ports to quickly load and unload containers are also capable of lifting off the deck plates of these ships for access to containers located below decks. The containers are usually stacked on ships in an X-pattern. Not all container ships are equipped to carry all sizes of containers. Super container ships are typically capable of carrying at least 48/45/40/20 ft containers. Smaller container ships, particularly ones which also carry non-containerized cargo, sometimes may only be able to handle the more common 40 and 20 ft units. Container capacities of ships are given in TEUs (twenty-foot equivalent units) or FEUs (forty-foot equivalent units). In other words, the TEU number is the total number of 20 ft containers of the standard height the ship is theoretically capable of carrying, though not all parts of the ship may actually be set up for holding 20 ft containers.

Due to so-called vessel-sharing agreements, where carriers pool equipment on a given route, one may find containers of one carrier aboard the vessel of another. Also, in cases where no single carrier serves the entire route of a container's travel, a container may also be interchanged from one ocean carrier to another. Containers are also often carried inland on barges on navigable rivers. The container standards allow containers to be handled by both very sophisticated container handling equipment and by very simple equipment. In essence, as long as one has a crane capable of lifting the weight of the loaded container, one can handle the container. In this case, cables with hooks are attached to the four top lift points, coming together at the main hook of the crane. Usually one or more lines are attached to the lower connection points to keep the container from twisting and to manually maneuver it into place at its new location. This technique is still used at smaller third-world ports where labor is more readily available than complex equipment or when ship-board cranes of smaller vessels have to be used to load and unload containers at smaller ports. Some mid-range container ships have their own loading and unloading equipment that functions similar to dock-side container cranes. These ships have lifting equipment that runs on overhead rails that extend far enough out over the sides of the ship to be able to lift the containers on and off the dock. This type of equipment is expensive to maintain, however, because, being located atop the ship, the equipment is exposed to the elements while the ship is at sea. So, most ship-to-shore transfer of containers involving large container ships and large ports is done with large land-based container cranes. These cranes lock onto the containers with a piece called a spreader. The spreader can adjust to different lift-point spreads. These cranes allow very precise placement of containers and can also verify the actual weight of each container as it is being lifted (via equipment in the spreader-with this data being sent back through one of the control cables attached to the spreader).

Containers are not normally transferred directly from a ship to a railcar, though there are some exceptions. The reason for this is that the most logical sequence for unloading a container ship (which has to remain in balance) may not match with the most logical sequence for loading a double-stack train. Additionally, containers from one ship may go on different trains to different destinations. Similarly, trains reaching a port may carry containers destined for different locations served by different ships, or which, at the very least, need to be loaded on a ship in a very specific sequence. So, there is usually a rail intermodal terminal close to the actual dock, with transfers being made on a road chassis. Containers may be stored in transit on the chassis or stacked several-high. The equipment at a port-adjacent intermodal rail facility is almost the same as at inland intermodal facilities where containers and trailers are moved on and off intermodal trains. The equipment falls into two general categories-straddle cranes which span one or more tracks and paved areas for chassis placement and side-loaders. Straddle cranes may operate on fixed rails or with large rubber tires.

Figure 2:
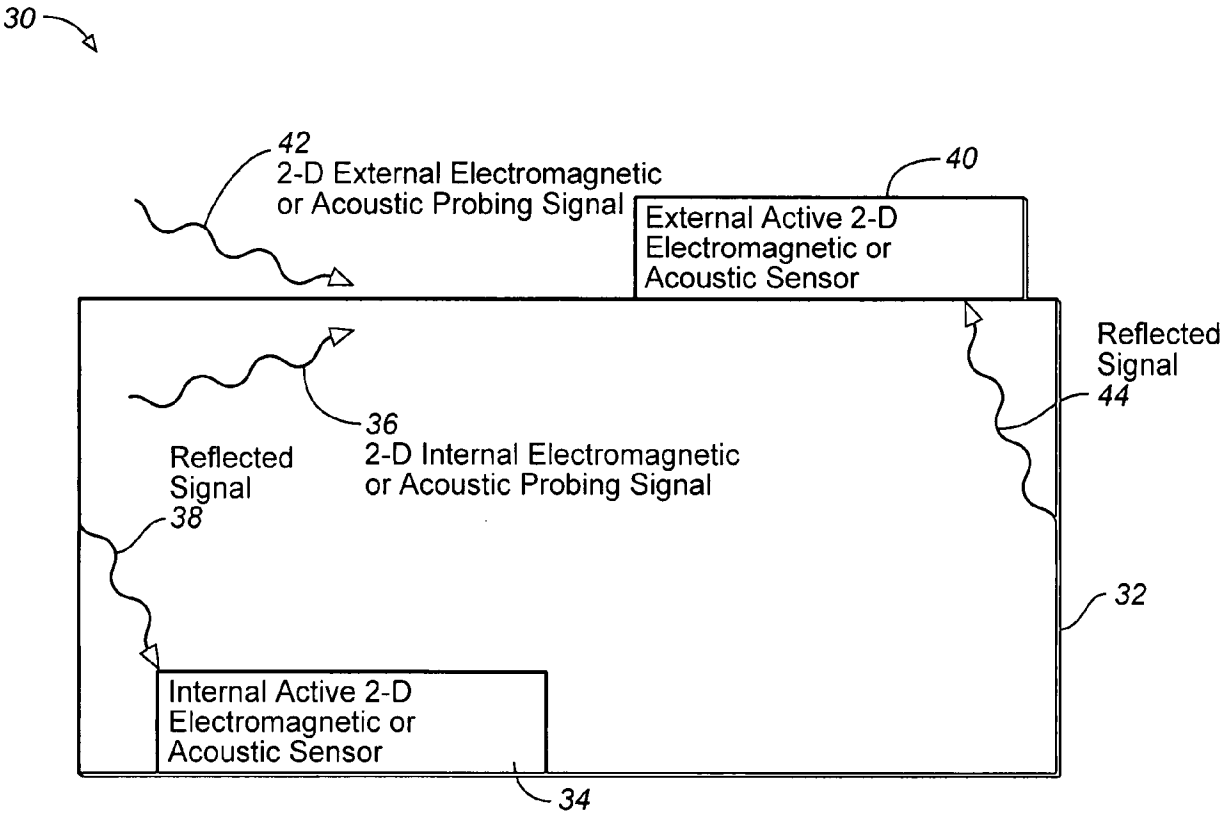
FIG. 2 illustrates an active 2-D electromagnetic (or acoustic) sensor placed inside (or outside) a container for the purposes of the present invention.

In one embodiment of the present invention, the block 12 (of FIG. 1) for substantially continuously probing each cargo container further comprises an active internal 2-D electromagnetic sensor 34 placed inside a container 32, as shown in FIG. 2. In this embodiment of the present invention, the active internal 2-D electromagnetic sensor 34 is configured to substantially continuously probe at least one cargo container by generating a 2-D internal electromagnetic probing signal 36, wherein at least one response signal 38 is indicative of at least one threat signature. The active internal 2-D electromagnetic sensor 34 placed inside the container 32 can be used to probe any given container for intrusions, break-ins, searching for foreign objects inside the container, and other attacks on the integrity of the container.

Figure 3:
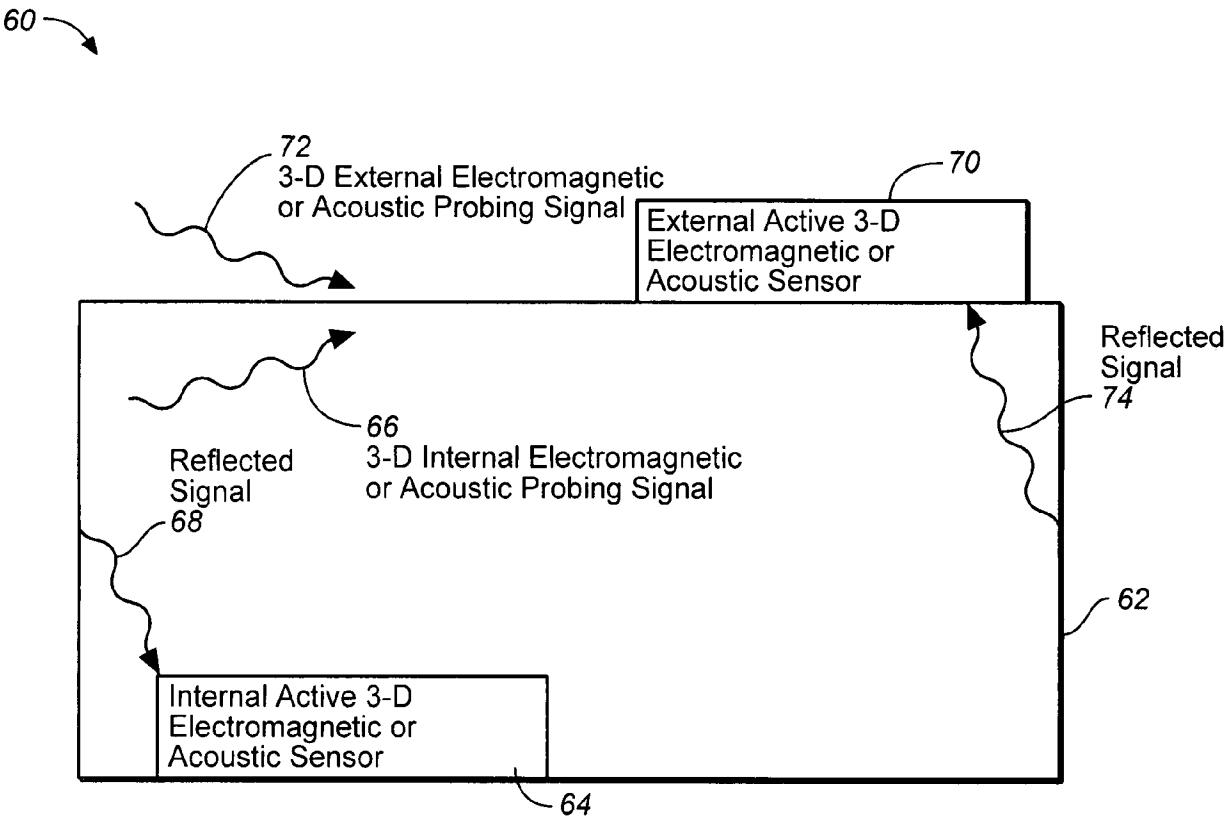
FIG. 3 depicts an active 3-D electromagnetic (or acoustic) sensor placed inside (or outside) a container for the purposes of the present invention.

In another embodiment of the present invention, the block 12 (of FIG. 1) for substantially continuously probing each cargo container further comprises an active internal 3-D electromagnetic sensor 64 placed inside a container 62, as illustrated in FIG. 3. In this embodiment of the present invention, the active 3-D electromagnetic sensor 64 is configured to substantially continuously probe the cargo container 62 by generating a 3-D internal probing signal 66, wherein at least one response signal 68 is indicative of at least one threat signature. The active internal 3-D electromagnetic sensor 64 placed inside the container 62 can be used to probe any given container for intrusions, break-ins, searching for foreign objects inside the container, and other attacks on the integrity of the container.

In one more embodiment of the present invention, the block 12 (of FIG. 1) for substantially continuously probing each cargo container further comprises an active 2-D electromagnetic sensor 40 placed outside the container 32, as shown in FIG. 2. In this embodiment of the present invention, the active 2-D electromagnetic sensor 40 is configured to substantially continuously probe the container 32 by generating a 2-D external probing signal 42, wherein at least one response signal 44 is indicative of at least one threat signature. The active external 2-D electromagnetic sensor 40 placed inside the container 32 can be used to probe any given container for intrusions, break-ins, searching for foreign objects inside the container, and other attacks on the integrity of the container.

Yet, in one more embodiment of the present invention, the block 12 (of FIG. 1) for substantially continuously probing each cargo container further comprises an active 3-D electromagnetic sensor 70 placed outside the container 62, as shown in FIG. 3. In this embodiment of the present invention, the active 3-D external electromagnetic sensor 70 is configured to substantially continuously probe the container 62 by generating a 3-D external probing signal 72, wherein at least one response signal 74 is indicative of at least one threat signature. The active external 3-D electromagnetic sensor 70 placed inside the container 62 can be used to probe any given container for intrusions, break-ins, searching for foreign objects inside the container, and other attacks on the integrity of the container.

In one additional embodiment of the present invention, the block 12 (of FIG. 1) for substantially continuously probing each cargo container further comprises a grid/array of electromagnetic sensor pads placed inside the cargo ship (not shown). In this embodiment of the present invention, the grid/array of electromagnetic sensor pads is configured to substantially continuously probe at least one cargo container, wherein at least one response signal is indicative of at least one threat signature. The topology of this grid can be optimized to increase the probability of the detection of the threat signatures.

Yet, in one more additional embodiment of the present invention, the block 12 (of FIG. 1) for substantially continuously probing each cargo container further comprises a beam-forming grid/array of electromagnetic sensor pads (not shown) placed inside the cargo ship. In this embodiment of the present invention, the beam-forming grid/array of electromagnetic sensor pads is configured to form an electromagnetic beam signal, wherein the electromagnetic beam signal is used to ping at least one cargo container, and wherein at least one response signal is indicative of at least one threat signature. The topology of this grid can be optimized to obtain the optimum beam and to increase the probability of the detection of the threat signatures.

In one embodiment of the present invention, the Pulse width modulation (PWM) technique can be used for the purposes of the present invention to implement the 2-D electromagnetic probing signal 36 (or 42), the 3-D electromagnetic probing signal 66 (or 72), as well as the probing signals of the grid/array of electromagnetic sensor pads.

Indeed, the PWM technique is widely used for controlling analog circuits with a microprocessor's digital outputs. PWM is employed in a wide variety of applications, ranging from measurement and communications to power control and conversion. Through the use of high-resolution counters, the duty cycle of a square wave is modulated to encode a specific analog signal level. The PWM signal is still digital because, at any given instant of time, the full DC supply is either fully on or fully off. The voltage or current source is supplied to the analog load by means of a repeating series of on and off pulses. The on-time is the time during which the DC supply is applied to the load, and the off-time is the period during which that supply is switched off. Given a sufficient bandwidth, any analog value can be encoded with PWM. Regular sampled PWM makes the width of the pulse proportional to the value of the modulating signal at the beginning of the carrier period. There are many ways to generate a Pulse Width Modulated signal other than fixed FREQUENCY sine sawtooth. For three phase systems the modulation of a Voltage Source Inverter can generate a PWM signal for each phase leg by comparison of the desired output voltage waveform for each phase with the same sawtooth.

In another embodiment of the present invention, the AC Signal Injection technique can be used for the purposes of the present invention to implement the 2-D electromagnetic probing signal 36 (or 42), as well as the 3-D electromagnetic probing signal 66 (or 72).

AC signal can detect the location of some low impedance ground faults. Tektronix USA, located at 1500 North Greenville Avenue Richardson, Tex. 75081, United States manufactures AC Current Probes CT1, CT2, and CT6. These devices have the following features: high bandwidth ultra-low inductance; very small form factor; current waveforms up to <200 pSec rise times. The CT1 and CT2 current probes are designed for permanent or semi-permanent in-circuit installation. Each probe consists of a current transformer and an interconnecting cable. The current transformers have a small hole through which a current carrying conductor is passed during circuit assembly. One probe cable can be used to monitor several current transformers that have been wired into a circuit.

The CT1, CT2 and CT6 high FREQUENCY current transformers are dynamic (i.e., non-DC) current measuring devices. They are typically used in conjunction with compatible high bandwidth oscilloscopes and other instruments to observe and/or record high FREQUENCY current waveforms. The CT1, CT2 and CT6 normally operate directly into 50Ω scopes and other measuring device inputs. The CT1 or CT2 can be used with 1 MΩ input systems. The CT1 or CT6 can make differential current measurements to 1 GHz and 2 GHz, respectively, by passing two wires carrying opposing currents through the same core. The displayed result is the difference current. The CT1, CT2 and CT6 all have low FREQUENCY roll off characteristics. Low FREQUENCY "droop" will exhibit itself when the pulse width approaches the L/R time constant of the specific transformer. Two CT1 or CT2 current transformers with matching probe cables can be used to measure propagation delay (transit time) between the input and output currents of high FREQUENCY devices. The probe outputs are connected to the inputs of dual channel real-time or sampling scopes.

In one embodiment of the present invention, a magnetic sensor can be used to detect the electromagnetic response signals 38, 44, 74, or 68.

Magnetic Sensor.

Magnetic sensors differ from most other detectors in that they do not directly measure the physical property of interest. Devices that monitor properties such as temperature, pressure, strain, or flow provide an output that directly reports the desired parameter. Magnetic sensors, on the other hand, detect changes, or disturbances, in magnetic fields that have been created or modified, and from them derive information on properties such as direction, presence, rotation, angle, or electrical currents. The output signal of these sensors requires some signal processing for translation into the desired parameter. Although magnetic detectors are somewhat more difficult to use, they do provide accurate and reliable data-without physical contact.

Magnetic sensors can be classified according to low-, medium-, and high-field sensing range: magnetic sensors that detect magnetic fields <1 μG (microgauss) are considered low-field sensors; magnetic sensors with a range of 1 μG to 10 G are Earth's field sensors; magnetic sensors that sense fields >10 G are referred to as bias magnet field sensors.

A magnetic field is a vector quantity with both magnitude and direction. The scalar sensor measures the field's total magnitude but not its direction. The omnidirectional sensor measures the magnitude of the component of magnetization that lies along its sensitive axis. The bidirectional sensor includes direction in its measurements. The vector magnetic sensor incorporates two or three bidirectional detectors.

Some magnetic sensors have a built-in threshold and produce an output only when it is surpassed.

Low-Field Sensors

Low-field sensors tend to be bulky and costly compared to other magnetic devices. Care must be taken to account for the effects of the Earth's field, whose daily variations may exceed the sensor's measurement range. The devices are used for medical applications and military surveillance.

In one embodiment of the present invention, a low-field magnetic sensor can be used to detect the electromagnetic response signals 38, 44, 74, or 68.

SQUID.

The most sensitive low-field sensor is the superconducting quantum interference device (SQUID). Developed about 1962, it is based on Brian J. Josephson's work on the point-contact junction designed to measure extremely low currents. SQUID magnetometers can detect fields from several femtotesla up to 9 tesla, a range of more than 15 orders of magnitude. This is essential in medical applications since the neuromagnetic field of the human brain is only a few tenths of a femtotesla; Earth's magnetic field, by way of comparison, is ~50 microtesla, or 0.5 oersted. SQUIDs require cooling to liquid helium temperature (4 kelvin) at present, but devices are under development that will operate at higher temperatures.

Search-Coil.

The basic search-coil magnetometer is based on Faraday's law of induction, which states that the voltage induced in a coil is proportional to the changing magnetic field in the coil. This induced voltage creates a current that is proportional to the rate of change of the field. The sensitivity of the search-coil is dependent on the permeability of the core and the area and number of turns of the coil. Because search-coils work only when they are in a varying magnetic field or moving through one, they cannot detect static or slowly changing fields. Inexpensive and easily manufactured, the devices are commonly found in the road at traffic control signals.

In one embodiment of the present invention, an inexpensive Search-Coil magnetic sensor can be used to detect the electromagnetic response signals 38, 44, 74, or 68.

Other Low-Field Sensors.

Other low-field sensor technologies include nuclear precession, optically pumped, and fiber-optic magnetometers. These precision instruments are used in laboratories and medical applications. For instance, the long-term stability of the nuclear precession magnetometer can be as low as 50 pT/yr.

Earth's Field (Medium-Field) Sensors

The magnetic range of medium-field sensors lends itself well to using the Earth's magnetic field to determine compass headings for navigation, detect anomalies in it for vehicle sensing, and measure the derivative of the change in field to determine yaw rate.

Flux Gate.

The flux-gate magnetometer, the most widely used sensor for compass-based navigation systems, was developed about 1928 and later refined by the military for submarine detection. The devices have also been used for geophysical prospecting and airborne magnetic field mapping operations. The most common type, called the second harmonic device, incorporates two coils, a primary and a secondary, wrapped around a common high-permeability ferromagnetic core. The core's magnetic induction changes in the presence of an external magnetic field. A drive signal applied to the primary winding at frequency f (e.g., 10 kHz) causes the core to oscillate between saturation points. The secondary winding outputs a signal that is coupled through the core from the primary winding. This signal is affected by changes in the core's permeability and appears as an amplitude variation in the sensing coil's output. The signal can be demodulated with a phase-sensitive detector and low pass filtered to retrieve the magnetic field value. Another way of looking at the flux-gate operating principle is to sense the ease of or resistance to core saturation caused by the change in its magnetic flux. The difference is due to the external magnetic field. A well-designed flux-gate magnetometer can sense a signal in the tens of microgauss range, as well as measure both magnitude and direction of static magnetic fields. The upper frequency band limit is ~1 kHz due to the drive frequency limit of ~10 kHz. These devices tend to be bulky and not so rugged as smaller, more integrated sensor technologies.

In one embodiment of the present invention, a Flux Gate magnetic sensor can be used to detect the electromagnetic response signals 38, 44, 74, or 68.

Magnetoinductive.

Magnetoinductive magnetometers are relatively new, with the first patent issued in 1989. This sensor is simply a single winding coil on a ferromagnetic core that changes permeability within the Earth's field. The coil is the inductance element in a L/R relaxation oscillator. The oscillator's frequency is proportional to the field being measured. A static DC current is used to bias the coil in a linear region of operation. As the sensor is rotated 90° from the applied magnetic field, the observed frequency shift can be as much as 100%. The oscillator frequency can be monitored by a microprocessor's capture/compare port to determine field values. These magnetometers are simple in design, inexpensive, and have low power requirements. Their temperature range is −20° C. to 70° C., and they are repeatable to within 4 mG. Automatic assembly and axis alignment are difficult due to the sensor's small size and its physical configuration.

Anisotropic Magnetoresistive (AMR).

William Thompson, later Lord Kelvin, first observed the magnetoresistive effect in ferromagnetic metals in 1856. His discovery had to wait more than 100 years before thin film technology could make it into a practical sensor. Magnetoresistive sensors come in a variety of shapes and forms and are used in high-density read heads for tape and disk drives, as well as for automotive wheel speed and crankshaft measurement, compass navigation, vehicle detection, and current sensing. AMR sensors are well suited to measuring both linear and angular position and displacement in the Earth's magnetic field. These devices are made of a nickel-iron (Permalloy) thin film deposited on a silicon wafer and patterned as a resistive strip. The film's properties cause it to change resistance by 2%–3% in the presence of a magnetic field. In a typical configuration, four of these resistors are connected in a Wheatstone bridge to permit measurement of both field magnitude and direction along a single axis. The bandwidth is usually in the 1–5 MHz range. The reaction of the magnetoresistive effect is very fast and not limited by coils or oscillating frequencies. AMR sensors can be bulk manufactured on silicon wafers and mounted in commercial IC packages, permitting automated assembly with other circuit and systems components. They also offer high sensitivity, small size, and noise immunity.

In one embodiment of the present invention, an AMR magnetic sensor can be used to detect the electromagnetic response signals 38, 44, 74, or 68.

Bias Magnetic Field Sensors

Most industrial sensors use permanent magnets as a source of the magnetic field to be detected. These magnets magnetize, or bias, ferromagnetic objects close to the sensor, which then detects changes in the total field around itself. Bias field sensors must detect fields that are typically larger than the Earth's, but must not be temporarily upset or permanently affected by a large field. Sensors in this category include reed switches, InSb magnetoresistors, Hall devices, and GMR sensors. Although some of these sensors, such as magnetoresistors, are capable of measuring fields up to several teslas, others, such as GMR devices, can detect fields down to the milligauss region with research extending their capabilities to the microgauss region.

In one embodiment of the present invention, a Bias Magnetic Field Sensor can be used to detect the electromagnetic response signals 38, 44, 74, or 68.

Reed Switches.

The Reed Switch can be considered the simplest magnetic sensor to produce a usable output for industrial control. It consists of a pair of flexible, ferromagnetic contacts hermetically sealed in an inert gas filled container, often glass. The magnetic field along the long axis of the contacts magnetizes the contacts and causes them to attract each other, closing the circuit. Because there is usually considerable hysteresis between the closing and releasing fields, the switches are quite immune to small fluctuations in the field. Reed switches are maintenance free and highly immune to dirt and contamination. Rhodium-plated contacts ensure long contact life. Typical capabilities are 0.1–0.2 A switching current and 100–200 V switching voltage. Contact life is measured at $10^6$–$10^7$ operations at 10 mA. Reed switches are available with normally open, normally closed, and class C contacts. Latching reed switches are also available. Mercury-wetted reed switches can switch currents as high as 1 A and have no contact bounce. Low cost, simplicity, reliability, and zero power consumption make reed switches popular in many applications. The addition of a separate small permanent magnet yields a simple proximity switch often used in security systems to monitor the opening of doors or windows. The magnet, affixed to the movable part, activates the reed switch when it comes close enough. The desire to sense almost everything in cars is increasing the number of reed switch sensing applications in the automotive industry.

In one embodiment of the present invention, a low cost, simple, reliable, and having zero power consumption Reed Switch can be used to detect the electromagnetic response signals 38, 44, 74, or 68.

Lorentz Force Devices.

There are several sensors that use the Lorentz force, or Hall effect, on charge carriers in a semiconductor. The Lorentz force equation describes the force FL experienced by a charged particle with charge q moving with velocity v in a magnetic field B. Since FL, v, and B are vector quantities, they have both magnitude and direction. The Lorentz force is proportional to the cross product between the vectors representing velocity and magnetic field; it is therefore perpendicular to both of them and, for a positively charged carrier, has the direction of advance of a right-handed screw rotated from the direction of v toward the direction of B. The acceleration caused by the Lorentz force is always perpendicular to the velocity of the charged particle; therefore, in the absence of any other forces, a charge carrier follows a curved path in a magnetic field. The Hall effect is a consequence of the Lorentz force in semiconductor materials. When a voltage is applied from one end of a slab of semiconductor material to the other, charge carriers begin to flow. If at the same time a magnetic field is applied perpendicular to the slab, the current carriers are deflected to the side by the Lorentz force. Charge builds up along the side until the resulting electrical field produces a force on the charged particle sufficient to counteract the Lorentz force. This voltage across the slab perpendicular to the applied voltage is called the Hall voltage.

Magnetoresistors.

The simplest Lorentz force devices are magnetoresistors that use semiconductors such as InSb and InAs with high room-temperature carrier mobility. If a voltage is applied along the length of a thin slab of semiconductor material, a current will flow and a resistance can be measured. When a magnetic field is applied perpendicular to the slab, the Lorentz force will deflect the charge carriers. If the width of the slab is greater than the length, the charge carriers will cross the slab without a significant number of them collecting along the sides. The effect of the magnetic field is to increase the length of their path and, thus, the resistance. An increase in resistance of several hundred percent is possible in large fields. To produce sensors with hundreds to thousands of ohms of resistance, long, narrow semiconductor stripes a few micrometers wide are produced using photolithography. The required length-to-width ratio is accomplished by forming periodic low-resistance metal shorting bars across the traces. Each shorting bar produces an equipotential across the semiconductor stripe. The result is, in effect, a number of small semiconductor elements with the proper length-to-width ratio connected in series. A second method is to use lapped wafers cut from boules that have needle-shaped low-resistance precipitates of NiSb in a matrix of InSb. These precipitates serve as the shorting bars. Magnetoresistors formed from InSb are relatively insensitive in low fields; in high fields, however, they exhibit a resistance that changes approximately as the square of the field. They are sensitive only to that component of the magnetic field perpendicular to the slab and not to whether the field is positive or negative. Their large temperature coefficients of resistivity are caused by the change in mobility of the charge carriers with temperature. The sensors are made with either single resistors or pairs of spaced resistors. The latter are used to measure field gradients and are usually combined with external resistors to form a Wheatstone bridge. A permanent magnet is often incorporated in the field gradient sensor to bias the magnetoresistors up to a more sensitive part of their characteristic curve.

Hall Sensors.

Hall sensors typically use n-type silicon when cost is of primary importance and GaAs for higher temperature capability due to its larger band gap. In addition, InAs, InSb, and other semiconductor materials are gaining popularity due to their high carrier mobilities that result in greater sensitivity and frequency response capabilities above the 10–20 kHz typical of Si Hall sensors. Compatibility of the Hall sensor material with semiconductor substrates is important since Hall sensors are often used in integrated devices that include other semiconductor structures. Charge carriers are deflected to the side and build up until they create a Hall voltage across the slab with a force equaling the Lorentz force on the charge carriers. At this point the charge carriers travel the length in approximately straight lines, and no additional charge builds up. Since the final charge carrier path is essentially along the applied electric field, the end-to-end resistance changes little with the magnetic field. When the Hall voltage is measured between electrodes placed at the middle of each side, the resulting differential voltage is proportional to the magnetic field perpendicular to the slab. It also changes sign when the sign of the magnetic field changes. The ratio of the Hall voltage to the input current is called the Hall resistance, and the ratio of the applied voltage to the input current is called the input resistance. The Hall resistance and Hall voltage increase linearly with applied field to several teslas (tens of kilogauss). The temperature dependence of the voltage and the input resistance is governed by the temperature dependence of the carrier mobility and that of the Hall coefficient. Different materials and different doping levels result in tradeoffs between sensitivity and temperature dependence.

Integrated Hall Sensors.

Hall devices are often combined with semiconductor elements to create integrated sensors. Adding comparators and output devices to a Hall element, for example, yields unipolar and bipolar digital switches. Adding an amplifier increases the relatively low voltage signals from a Hall device to produce ratiometric linear Hall sensors with an output centered on one-half the supply voltage. Power usage can even be reduced to extremely low levels by using a low duty cycle.

In one embodiment of the present invention, having relatively low power consumption Integrated Hall sensor can be used to detect the electromagnetic response signals 38, 44, 74, or 68.

Giant Magnetoresistive (GMR) Devices.

Large magnetic field dependent changes in resistance are possible in thin film ferromagnetic/nonmagnetic metallic multilayers. The phenomenon was first observed in France in 1988, when changes in resistance with magnetic field of up to 70% were seen. Compared to the small percent change in resistance observed in anisotropic magnetoresistance, this phenomenon was truly giant magnetoresistance. The resistance of two thin ferromagnetic layers separated by a thin nonmagnetic conducting layer can be altered by changing the moments of the ferromagnetic layers from parallel to antiparallel, or parallel but in the opposite direction. Layers with parallel magnetic moments will have less scattering at the interfaces, longer mean free paths, and lower resistance. Layers with antiparallel magnetic moments will have more scattering at the interfaces, shorter mean free paths, and higher resistance. For spin-dependent scattering to be a significant part of the total resistance, the layers must be thinner than the mean free path of electrons in the bulk material. For many ferromagnets the mean free path is tens of nanometers, so the layers themselves must each be typically <10 nm (100 Å). It is therefore not surprising that GMR was only recently observed with the development of thin film deposition systems.

Various Methods of Obtaining Antiparallel Magnetic Alignment in Thin Ferromagnetic-Conductor Multilayers.

The structures currently used in GMR sensors are unpinned sandwiches and antiferromagnetic multilayers, although spin valves are of considerable interest especially for magnetic read heads. Unpinned sandwich GMR materials consist of two soft magnetic layers of iron, nickel, and cobalt alloys separated by a layer of a nonmagnetic conductor such as copper. With magnetic layers 4–6 nm (40–60 Å) thick separated by a conductor layer typically 3–5 nm thick, there is relatively little magnetic coupling between the layers. For use in sensors, the sandwich material is usually patterned into narrow stripes. The magnetic field caused by a current of a few milliamps per micrometer of stripe width flowing along the stripe is sufficient to rotate the magnetic layers into antiparallel or high-resistance alignment. An external field of 3–4 kA/m (35–50 Oe) applied along the length of the stripe is sufficient to overcome the field from the current and rotate the magnetic moments of both layers parallel to the external field. A positive or negative external field parallel to the stripe will also produce the same change in resistance. An external field applied perpendicular to the stripe will have little effect due to the demagnetizing fields associated with the extremely narrow dimensions. The value usually associated with the GMR effect is the percent change in resistance normalized by the saturated or minimum resistance. Sandwich materials have values of GMR typically 4%–9% and saturate with 2.4–5 kA/m (30–60 Oe) applied field. Antiferromagnetic multilayers consist of multiple repetitions of alternating conducting magnetic and nonmagnetic layers. Because multilayers have more interfaces than do sandwiches, the size of the GMR effect is larger. The thickness of the nonmagnetic layers is less than that for sandwich material (typically 1.5–2.0 nm), and it is critical. For certain thicknesses only, the polarized conduction electrons cause antiferromagnetic coupling between the magnetic layers. Each magnetic layer has its magnetic moment antiparallel to the moments of the magnetic layers on each side, exactly the condition needed for maximum spin-dependent scattering. A large external field can overcome the coupling that causes this alignment, and can align Multilayer GMR materials have better linearity and lower hysteresis than typical sandwich GMR material.

Spin Valves.

Spin valves, or antiferromagnetically pinned spin valves, are similar to the unpinned spin valves or sandwich materials described above. An additional layer of an antiferromagnetic material is provided on the top or the bottom. The antiferromagnetic material such as FeMn or NiO couples to the adjacent magnetic layer and pins it in a fixed direction; the other magnetic layer is free to rotate. These materials do not require the field from a current to achieve antiparallel alignment or a strong antiferromagnetic exchange coupling to adjacent layers. The direction of the pinning layer is usually fixed by elevating the temperature of the GMR structure above the blocking temperature. Above this temperature, the antiferromagnet is no longer coupled to the adjacent magnetic layer. The structure is then cooled in a strong magnetic field that fixes the direction of the moment of the pinned layer. Because the spin valve material looses its orientation if heated above its blocking temperature, spin valve sensors must operate below that temperature. Since the change in magnetization in the free layer is due to rotation rather than domain wall motion, hysteresis is reduced. Values for GMR are 4%–20% and saturation fields are 0.8–6 kA/m (10–80 Oe). Spin valves are receiving considerable interest from the research community due to their potential for use in magnetic read heads for high-density data storage applications. IBM has announced the introduction of a 16.8 GB hard drive with a spin valve read head. Bridge sensor designs using spin valve materials have also been described in the literature, and rotational position sensors in a product bulletin.

SDT

In the Spin-dependent tunneling (SDT) structures an extremely thin insulating layer is substituted for the conductive interlayer separating the two magnetic layers. The conduction is due to quantum tunneling through the insulator. The size of the tunneling current between the two magnetic layers is modulated by the direction between the magnetization vectors in the two layers. The conduction path must be perpendicular to the plane of the GMR material since there is such a large difference between the conductivity of the tunneling path and that of any path in the plane. Extremely small SDT devices measuring several micrometers on a side with high resistance can be fabricated using photolithography, which allows very dense packing of magnetic sensors in small areas. Although these recent materials are very much a topic of current research, values of GMR of 10%–25% have been observed. The saturation fields depend on the composition of the magnetic layers and the method of achieving parallel and antiparallel alignment. Values of saturation field range from 0.1 kA/m to 10 kA/m (1–100 Oe), offering the possibility of extremely sensitive magnetic sensors with very high resistance that promise to be suitable for battery operation.

Colossal Magnetoresistance.

Scientists, to surpass the term giant, have proceeded on to colossal magnetoresistive materials (CMR). Under certain conditions these mixed oxides undergo a semiconductor-to-metallic transition with the application of a magnetic field of a few teslas (tens of kilogauss). The size of the resistance ratios, measured at 103%–108%, have generated considerable excitement even though they initially required high fields and liquid nitrogen temperatures. Academic researchers have recently developed CMR materials that work at room temperature and have fabricated Wheatstone bridge topography sensors out of these materials. Although still a long way from commercial applications, these CMR materials bear watching.

GMR Circuit Techniques.

The best use of GMR materials for magnetic field sensors has so far been in Wheatstone bridge configurations, although simple GMR resistors and GMR half bridges can also be fabricated. A sensitive bridge can be made from four photolithographically patterned GMR resistors, two of which are active elements. These resistors can be as narrow as 2 μm, allowing a serpentine 10 k resistor to be patterned in an area as small as 100 μm2. The vary narrow width also makes the resistors sensitive only to the magnetic field component along their long dimension. Small magnetic shields are plated over two of the four equal resistors in a Wheatstone bridge, protecting them from the applied field and allowing them to act as reference resistors. Since they are fabricated from the same material, they have the same temperature coefficient as the active resistors. The two remaining GMR resistors are both exposed to the external field. The bridge output is therefore twice the output from a bridge with only one active resistor. The bridge output for a 10% change in these resistors is ~5% of the voltage applied to the bridge.

Smart Sensors.

Smart sensors with sensing elements and associated electronics such as amplification and signal conditioning on the same die are the latest trend. GMR materials are sputtered onto wafers and can therefore be directly integrated with semiconductor processes. The small sensing elements fit well with the other semiconductor structures and are applied after most of the semiconductor fabrication operations are complete. Because of the topography introduced by the many layers of polysilicon, metal, and oxides over the transistors, areas must be reserved with no underlying transistors or connections. These areas will have the GMR resistors. The GMR materials are actually deposited over the entire wafer, but the etched sensor elements remain only on these reserved, smooth areas on the wafers. Among the functions built into an integrated sensor are regulated voltage or current supplies to the sensor elements; threshold detection to provide a switched output when a preset field is reached; amplifiers; logic functions, including divide-by-2 circuits; and various options for outputs. With these elements, a 2-wire sensor can be designed that has two current levels—low when the field is below a threshold and high when the field is above the threshold. Onboard sensor electronics can increase signal levels to significant voltages with the least pickup of interference. It is always best to amplify low-level signals close to where they are generated. Converting analog signals to digital (switched) outputs within the sensor is another way to minimize electronic noise. The use of comparators and digital outputs makes the nonlinearity in the output of sandwich GMR materials of less concern. Even the hysteresis in such materials can be useful, since some hysteresis is usually built into comparators to avoid multiple triggering of the output due to noise. GMR materials have been successfully integrated with both BiCMOS and bipolar semiconductor underlayers. The wafers are processed with all but the final layer of connections complete. GMR material is deposited on the surface and patterned. The next step is the application of a passivation layer through which windows are cut to permit contact to both the upper metal layer in the semiconductor wafer and to the GMR resistors. The final layer of metal is then deposited and patterned to interconnect the GMR sensor elements and to connect them to the semiconductor underlayers. This layer also forms the pads to which wires will be bonded during packaging. A final passivation layer is deposited, magnetic shields and flux concentrators are plated and patterned, and windows are etched through to the pads.

In one embodiment of the present invention, a smart sensor can be used to detect the electromagnetic response signals 38, 44, 74, or 68.

GMR Sensor Applications

Proximity Detection.

A magnetic field sensor can directly detect a magnetic field from a permanent magnet, an electromagnet, or a current. Ferrous object presence sensing often entails the use of a biasing magnet that magnetizes a ferromagnetic object such as a gear tooth. The sensor then detects the combined magnetic fields from the object and the magnet. To keep its direct influence on the target to a minimum, the magnet is usually mounted on top of the sensor with its magnetic axis perpendicular to the sensitive axis of the sensor. Centering the biasing magnet such that there is little or no field in the sensitive direction of the sensor permits the use of a reasonably large magnet. Occasionally, a spacer is used between the sensor and the magnet to reduce the field at the sensor and thus the criticality of magnet placement. Biasing magnets are customarily used only if the ferrous object is nearby. Because the field from a dipole magnet falls off at the reciprocal of the distance cubed, it is difficult to magnetize an object several meters away with the field from a sensor-sized permanent magnet. In vehicle detection and certain other applications, the Earth's field acts as a biasing magnet and creates a magnetic signature from the parts of the vehicle that are magnetized by the Earth's field. Vehicles can thus be counted and classified as they pass over sensors in the road. Small, low-power GMR sensors and their associated electronics, memory, and battery can be packaged in a low-profile aluminum housing the size of a hand.

Currency Detection.

Currency detection is another application in which the biasing magnet is not mounted on the sensor. The particles in the ink on many countries' currency have ferromagnetic properties. Bills are passed over a permanent magnet array and magnetized along their direction of travel. A magnetic sensor located several inches away with its sensitive axis parallel to the direction of travel can detect the remnant field of the ink particles. The purpose of the biasing magnet in this case is to achieve a controlled orientation of the magnetic moments of the ink particles, resulting in a maximum and recognizable magnetic signature. Reversing the magnetizing field can actually invert the signature.

Displacement Sensing.

GMR bridge sensors can provide position information from small displacements associated with actuating components in machinery, proximity detectors, and linear position transducers. Due to the nonlinear characteristic of dipole magnetic fields produced by permanent magnets, the range of linear output may be limited.

Rotational Reference Detection.

GMR sensors offer a rugged, low-cost solution to rotational reference detection. High sensitivity and DC operation afford the GMR bridge sensor an advantage over inductive sensors, which tend to have very low outputs at low frequencies and can generate large noise signals when subjected to high-frequency vibrations. Because GMR sensors are field sensors, they do not measure the induced signal from the time rate of change of fields as is the case with variable reluctance sensors. The output from a GMR bridge sensor will have a minimum when the sensor is centered over a tooth or a gap and a maximum when a tooth approaches or recedes. Current in a wire creates a magnetic field that surrounds the wire or a trace on a PCB. The field decreases as the reciprocal of distance from the wire; GMR bridge sensors can be used to detect this field and thus either DC or AC currents. Bipolar AC current will be rectified by the sensor's omnipolar sensitivity unless some method is used to bias the sensor away from zero. Unipolar and pulsed currents can be measured with good reproduction of fast rise time components due to the sensor's excellent high-frequency response. Since the films are extremely thin, response to frequencies up to 100 MHz is possible. Placing a wire immediately over or under the sensor will produce a field of ~0.080 A/m (1 mOe) per milliamp of current. The sensor can also be mounted immediately over a current-carrying trace on a PCB. High currents may require more separation between the sensor and the wire to keep the field within the sensor's range. Low currents may best be detected when the current is being carried by a trace on the chip immediately over the GMR resistors.

In one embodiment of the present invention, GMR sensors with rotational reference detection capabilities can be used to detect the electromagnetic response signals 38, 44, 74, or 68.

For example, GMW Associates, located at 955 Industrial Road, San Carlos, Calif. 94070, manufactures new magnetic angular sensor 2SA-10 that detects the absolute angular position of a small magnet that is positioned above the device surface. The 2SA-10 is an integrated combination of a CMOS Hall circuit and a thin ferromagnetic disk. The CMOS circuit contains two pairs of Hall-elements for each of the two directions parallel with the chip surface X and Y. The ferromagnetic disk amplifies the external magnetic field and concentrates it on the Hall elements.

Referring still to FIG. 2, in one embodiment of the present invention, the block 12 (of FIG. 1) for substantially continuously probing each cargo container further comprises an active internal 2-D acoustic sensor 34 placed inside the container 32. In this embodiment of the present invention, the active internal 2-D acoustic sensor 34 is configured to substantially continuously probe at least one cargo container by generating a 2-D internal acoustic probing signal 36, wherein at least one response signal 38 is indicative of at least one threat signature. The active internal 2-D acoustic sensor 34 placed inside the container 32 can be used to probe any given container for intrusions, break-ins, searching for foreign objects inside the container, and other attacks on the integrity of the container.

In another embodiment of the present invention, the block 12 (of FIG. 1) for substantially continuously probing each cargo container further comprises an active internal 3-D acoustic sensor 64 placed inside the container 62, as illustrated in FIG. 3. In this embodiment of the present invention, the active 3-D acoustic sensor 64 is configured to substantially continuously probe the cargo container 62 by generating a 3-D internal acoustic probing signal 66, wherein at least one response signal 68 is indicative of at least one threat signature. The active internal 3-D acoustic sensor 64 placed inside the container 62 can be used to probe any given container for intrusions, break-ins, searching for foreign objects inside the container, and other attacks on the integrity of the container.

In one more embodiment of the present invention, the block 12 (of FIG. 1) for substantially continuously probing each cargo container further comprises an active 2-D acoustic sensor 40 placed outside the container 32, as shown in FIG. 2. In this embodiment of the present invention, the active 2-D acoustic sensor 40 is configured to substantially continuously probe the container 32 by generating a 2-D external acoustic probing signal 42, wherein at least one response signal 44 is indicative of at least one threat signature. The active external 2-D acoustic sensor 40 placed inside the container 32 can be used to probe any given container for intrusions, break-ins, searching for foreign objects inside the container, and other attacks on the integrity of the container.

Yet, in one more embodiment of the present invention, the block 12 (of FIG. 1) for substantially continuously probing each cargo container further comprises an active 3-D acoustic sensor 70 placed outside the container 62, as shown in FIG. 3. In this embodiment of the present invention, the active 3-D external acoustic sensor 70 is configured to substantially continuously probe the container 62 by generating a 3-D external acoustic probing signal 72, wherein at least one response signal 74 is indicative of at least one threat signature. The active external 3-D acoustic sensor 70 placed inside the container 62 can be used to probe any given container for intrusions, break-ins, searching for foreign objects inside the container, and other attacks on the integrity of the container.

In one additional embodiment of the present invention, the block 12 (of FIG. 1) for substantially continuously probing each cargo container further comprises a grid/array of acoustic sensor pads (not shown) placed inside the cargo ship. In this embodiment of the present invention, the grid/array of acoustic sensor pads is configured to substantially continuously probe at least one cargo container, wherein at least one response signal is indicative of at least one threat signature. The topology of the grid/array of acoustic sensor pads can be optimized to optimize the probability of detection of at least one threat signature.

Yet, in one more embodiment of the present invention, the block 12 (of FIG. 1) for substantially continuously probing each cargo container further comprises a beam-forming grid/array of acoustic sensor pads (not shown) placed inside the cargo ship. In this embodiment of the present invention, the beam-forming grid/array of acoustic sensor pads is configured to form an acoustic beam signal, wherein the acoustic beam signal is used to ping at least one cargo container, and wherein at least one response signal is indicative of at least one threat signature. The topology of the beam-forming grid/array of acoustic sensor pads can be optimized to form the optimum beam that could optimize probability of detection of at least one threat signature.

In one embodiment of the present invention, the an active internal 2-D acoustic sensor 34 placed inside the container 32, the active internal 3-D acoustic sensor 64 placed inside the container 62, the active 2-D acoustic sensor 40 placed outside the container 32, the active 3-D acoustic sensor 70 placed outside the container 62, or components of the grid/array of acoustic sensor pads can be implemented by using a microphone.

Acoustic wave sensors are so named because their detection mechanism is a mechanical, or acoustic, wave. As the acoustic wave propagates through or on the surface of the material, any changes to the characteristics of the propagation path affect the velocity and/or amplitude of the wave. Changes in velocity can be monitored by measuring the frequency or phase characteristics of the sensor and can then be correlated to the corresponding physical quantity being measured. Virtually all acoustic wave devices and sensors use a piezoelectric material to generate the acoustic wave. Piezoelectricity was discovered by brothers Pierre and Paul-Jacques Curie in 1880, received its name in 1881 from Wilhelm Hankel, and remained largely a curiosity until 1921, when Walter Cady discovered the quartz resonator for stabilizing electronic oscillators. Piezoelectricity refers to the production of electrical charges by the imposition of mechanical stress. The phenomenon is reciprocal. Applying an appropriate electrical field to a piezoelectric material creates a mechanical stress. Piezoelectric acoustic wave sensors apply an oscillating electric field to create a mechanical wave, which propagates through the substrate and is then converted back to an electric field for measurement.

Among the piezoelectric substrate materials that can be used for acoustic wave sensors and devices, the most common are quartz ($SiO_2$), lithium tantalate ($LiTaO_3$), and, to a lesser degree, lithium niobate ($LiNbO_3$). Each has specific advantages and disadvantages, which include cost, temperature dependence, attenuation, and propagation velocity. An interesting property of quartz is that it is possible to select the temperature dependence of the material by the cut angle and the wave propagation direction. With proper selection, the first order temperature effect can be minimized. An acoustic wave temperature sensor may be designed by maximizing this effect. This is not true of lithium niobate or lithium tantalate, where a linear temperature dependence always exists for all material cuts and propagation directions. Other materials with commercial potential include gallium arsenide (GaAs), silicon carbide (SiC), langasite (LGS), zinc oxide (ZnO), aluminum nitride (AlN), lead zirconium titanate (PZT), and polyvinylidene fluoride (PVdF).

The sensors are made by a photo lithographic process. Manufacturing begins by carefully polishing and cleaning the piezoelectric substrate. Metal, usually aluminum, is then deposited uniformly onto the substrate. The device is spin-coated with a photo resist and baked to harden it. It is then exposed to UV light through a mask with opaque areas corresponding to the areas to be metalized on the final device. The exposed areas undergo a chemical change that allows them to be removed with a developing solution. Finally, the remaining photo resist is removed. The pattern of metal remaining on the device is called an interdigital transducer, or IDT. By changing the length, width, position, and thickness of the IDT, the performance of the sensor can be maximized.

Acoustic wave devices are described by the mode of wave propagation through or on a piezoelectric substrate. Acoustic waves are distinguished primarily by their velocities and displacement directions; many combinations are possible, depending on the material and boundary conditions. The IDT of each sensor provides the electric field necessary to displace the substrate and thus form an acoustic wave. The wave propagates through the substrate, where it is converted back to an electric field at the IDT on the other side. Transverse, or shear, waves have particle displacements that are normal to the direction of wave propagation and which can be polarized so that the particle displacements are either parallel to or normal to the sensing surface. Shear horizontal wave motion signifies transverse displacements polarized parallel to the sensing surface; shear vertical motion indicates transverse displacements normal to the surface.

A wave propagating through the substrate is called a bulk wave. The most commonly used bulk acoustic wave (BAW) devices are the thickness shear mode (TSM) resonator and the shear-horizontal acoustic plate mode (SH-APM) sensor. If the wave propagates on the surface of the substrate, it is known as a surface wave. The most widely used surface wave devices are the surface acoustic wave sensor and the shear-horizontal surface acoustic wave (SH-SAW) sensor, also known as the surface transverse wave (STW) sensor.

All acoustic wave devices are sensors in that they are sensitive to perturbations of many different physical parameters. Any change in the characteristics of the path over which the acoustic wave propagates will result in a change in output. All the sensors will function in gaseous or vacuum environments, but only a subset of them will operate efficiently when they are in contact with liquids. The TSM, SH-APM, and SH-SAW all generate waves that propagate primarily in the shear horizontal motion. The shear horizontal wave does not radiate appreciable energy into liquids, allowing liquid operation without excessive damping. Conversely, the SAW sensor has a substantial surface-normal displacement that radiates compression waves into the liquid, thus causing excessive damping. An exception to this rule occurs for devices using waves that propagate at a velocity lower than the sound velocity in the liquid. Regardless of the displacement components, such modes do not radiate coherently and are thus relatively undamped by liquids.

Other acoustic waves that are promising for sensors include the flexural plate wave (FPW), Love wave, surface-skimming bulk wave (SSBW), and Lamb wave. Before turning to application examples, it is helpful to briefly review each sensor type.

Bulk Wave Sensors

Thickness Shear Mode Resonator.

The TSM, widely referred to as a quartz crystal microbalance (QCM), is the best-known, oldest, and simplest acoustic wave device. The TSM typically consists of a thin disk of AT-cut quartz with parallel circular electrodes patterned on both sides. The application of a voltage between these electrodes results in a shear deformation of the crystal. This device is known as a resonator because the crystal resonates as electromechanical standing waves are created. The displacement is maximized at the crystal faces, making the device sensitive to surface interactions. The TSM resonator was originally used to measure metal deposition rates in vacuum systems where it was commonly used in an oscillator circuit. The oscillation frequency tracks the crystal resonance and indicates mass accumulation on the device surface. In the late 1960s, the TSM resonator was shown to operate as a vapor sensor. The TSM features simplicity of manufacture, ability to withstand harsh environments, temperature stability, and good sensitivity to additional mass deposited on the crystal surface. Because of its shear wave propagation component, the TSM resonator is also capable of detecting and measuring liquids, making it a good candidate for a biosensor. Unfortunately, these devices have the lowest mass sensitivity of the sensors examined here. Typical TSM resonators operate between 5 and 30 MHz. Making very thin devices that operate at higher frequencies can increase the mass sensitivity, but thinning the sensors beyond the normal range results in fragile devices that are difficult to manufacture and handle. Recent work has been done to form high-frequency TSM resonators using piezoelectric films and bulk silicon micro machining techniques Shear-Horizontal Acoustic Plate Mode Sensors.

These devices use a thin piezoelectric substrate, or plate, functioning as an acoustic waveguide that confines the energy between the upper and lower surfaces of the plate. As a result, both surfaces undergo displacement, so detection can occur on either side. This is an important advantage, as one side contains the interdigital transducers that must be isolated from conducting fluids or gases, while the other side can be used as the sensor. As with the TSM resonator, the relative absence of a surface-normal component of wave displacement allows the sensor to come into contact with liquid for biosensor applications. SH-APM sensors have been successfully used to detect microgram-per-liter levels of mercury, which is adequate for Safe Drinking Water Act compliance testing. Although more sensitive to mass loading than the TSM resonator, SH-APM sensors are less sensitive than surface wave sensors. There are two reasons: The first is that the sensitivity to mass loading and other perturbations depends on the thickness of the substrate, with sensitivity increasing as the device is thinned. The minimum thickness is constrained by manufacturing processes. Second, the energy of the wave is not maximized at the surface, which reduces sensitivity.

Surface Wave Sensors.

Surface Acoustic Wave Sensors. In 1887, Lord Rayleigh discovered the surface acoustic wave mode of propagation and in his classic paper predicted the properties of these waves. Named for their discoverer, Rayleigh waves have a longitudinal and a vertical shear component that can couple with a medium in contact with the device's surface. Such coupling strongly affects the amplitude and velocity of the wave. This feature enables SAW sensors to directly sense mass and mechanical properties. The surface motion also allows the devices to be used as micro actuators. The wave has a velocity that is ~5 orders of magnitude less than the corresponding electromagnetic wave, making Rayleigh surface waves among the slowest to propagate in solids. The wave amplitudes are typically ~10 Å and the wavelengths range from 1 to 100 microns. Because Rayleigh waves have virtually all their acoustic energy confined within one wavelength of the surface, SAW sensors have the highest sensitivity of the acoustic sensors reviewed. Typical SAW sensors operate from 25 to 500 MHz. One disadvantage of these devices is that Rayleigh waves are surface-normal waves, making them poorly suited for liquid sensing. When a SAW sensor is contacted by a liquid, the resulting compressional waves cause an excessive attenuation of the surface wave.

Shear-Horizontal Surface Acoustic Wave Sensors.

If the cut of the piezoelectric crystal material is rotated appropriately, the wave propagation mode changes from a vertical shear SAW sensor to a shear-horizontal SAW sensor. This dramatically reduces loss when liquids come into contact with the propagating medium, allowing the SH-SAW sensor to operate as a biosensor.

Comparison of Acoustic Wave Sensors.

In general, the sensitivity of the sensor is proportional to the amount of energy in the propagation path being perturbed. Bulk acoustic wave sensors typically disperse the energy from the surface through the bulk material to the other surface. This distribution of energy minimizes the energy density on the surface, which is where the sensing is done. SAW sensors, conversely, focus their energy on the surface, tending to make them more sensitive. Other design considerations when selecting acoustic wave sensors include oscillator stability and noise level.

Sensor Applications.

All acoustic wave sensors are sensitive, to varying degrees, to perturbations from many different physical parameters. As a matter of fact, all acoustic wave devices manufactured for the telecommunications industry must be hermetically sealed to prevent any disturbances because they will be sensed by the device and cause an unwanted change in output. The range of phenomena that can be detected by acoustic wave devices can be greatly expanded by coating the devices with materials that undergo changes in their mass, elasticity, or conductivity upon exposure to some physical or chemical stimulus. These sensors become pressure, torque, shock, and force detectors under an applied stress that changes the dynamics of the propagating medium. They become mass, or gravimetric, sensors when particles are allowed to contact the propagation medium, changing the stress on it. They become vapor sensors when a coating is applied that absorbs only specific chemical vapors. These devices work by effectively measuring the mass of the absorbed vapor. If the coating absorbs specific biological chemicals in liquids, the detector becomes a biosensor. As previously noted, a wireless temperature sensor can be created by selecting the correct orientation of propagation. The propagating medium changes with temperature, affecting the output. Detailed below are some of the more common applications of acoustic wave sensors.

Temperature Sensor.

Surface wave velocities are temperature dependent and are determined by the orientation and type of crystalline material used to fabricate the sensor. Temperature sensors based on SAW delay line oscillators have millidegree resolution, good linearity, and low hysteresis. They are, however, very sensitive to mass loading and so must be sealed in a hermetic package. A 124 MHz ST-cut quartz, surface-skimming bulk wave temperature sensor was recently reported to have a temperature coefficient of 32 ppm/ÞC and a resolution of 0.22 ÞC. It also exhibited three orders of magnitude less sensitivity to mass loading than do SAW sensors. The response time was found to be 0.3 s, $10^3$ faster than BAW sensors. These temperature sensors have the additional advantage of requiring no power and of being wireless, making them well suited for use in remote locations.

Pressure Sensor.

In 1975, the first reported use of SAW technology for a sensor application was in the form of a pressure sensor. SAW velocities are strongly affected by stresses applied to the piezoelectric substrate on which the wave is propagating. A SAW pressure sensor is therefore created by making the SAW device into a diaphragm. The uncompensated temperature drifts that tend to interfere with SAW pressure sensors can be minimized by placing a reference SAW device close to the measuring SAW on the same substrate and mixing the two signals. One sensor acts as a temperature detector, whose proximity to the pressure sensor ensures that both are exposed to the same temperature. However, the temperature sensor SAW must be isolated from the stresses that the pressure SAW experiences. SAW pressure sensors are passive (no power required), wireless, low cost, rugged, and extremely small and lightweight, making them well suited for measuring pressure in moving objects (e.g., car and truck tires). These characteristics offer advantages over technologies such as capacitive and piezoresistive sensors, which require operating power and are not wireless. A SAW pressure sensor weighing <1 g, with a resolution of 0.73 psi, was recently integrated into a car tire with excellent results. Such a system allows the operator to view the pressure in each tire from the comfort of the cabin. Correctly inflated tires lead to improved safety, greater fuel efficiency, and longer tire life. This technology is particularly interesting for the new run-flat (also called zero pressure or extended mobility) tire market.

Torque Sensor.

If a SAW device is rigidly mounted to a flat spot on a shaft, and the shaft experiences a torque, this torque will stress the sensor and turn it into a wireless, passive, lightweight torque detector. As the shaft is rotated one way, the SAW torque sensor is placed in tension; rotated the other way, it is placed in compression. For practical applications, two SAW torque sensors are used such that their centerlines are at right angles. Thus, when one sensor is in compression, the other is in tension. Since both sensors are exposed to the same temperature, the sum of the two signals minimizes any temperature drift effects. In comparison to other torque sensors, including resistive strain gauges, optical transducers, and torsion bars, SAW torque sensors offer lower cost, higher reliability, and wireless operation. Monitoring torque on trucks and cars will significantly improve handling and braking because torque measures wheel traction much better than the rpm sensors in current use.

Mass Sensor.

Of all the devices evaluated here, SAW sensors are the most sensitive to mass loads. This opens up several applications including particulate sensors and film thickness sensors. If the sensor is coated with an adhesive substance, it becomes a particulate sensor; any particle landing on the surface will remain there and perturb the wave propagation. A mass resolution of 3 pg for a 200 MHz ST-cut quartz SAW has been reported, which was 1000 3 the sensitivity of the 10 MHz TSM resonator tested. Particulate sensors are used in clean rooms, air quality monitors, and atmospheric monitors. Thickness sensors operate on basically the same principle as particulate sensors, except that they are not coated. The measured frequency shift is proportional to the mass of the deposited film, so the sensor provides thickness data by measuring the film density and acoustic impedance. This method is accurate, provided that the film is thin (ideally no more than a few percent of the acoustic wavelength). Most commercially available thickness sensors are based on TSM resonators. Although not so sensitive as SAW sensors, these devices offer ease of use and adequate sensitivity.

Dew Point/Humidity Sensor.

If a SAW sensor is temperature controlled and exposed to the ambient atmosphere, water will condense on it at the dew point temperature, making it an effective dew point sensor. Current commercial instruments for high-precision dew point measurements are based on optical techniques, which have cost, contamination, accuracy, sensitivity, and long-term stability issues. A 50 MHz YZ-cut lithium niobate SAW dew point sensor has been developed that is immune to common contaminants, has a resolution of ±0.025° C. (vs. ±0.2° C. for an optical sensor), is low cost, and is significantly more stable. Acoustic wave sensors with an elastic hygroscopic polymer coating make excellent humidity detectors. Three operational mechanisms contribute to the sensors' response: mass loading, acoustoelectric effects, and viscoelastic effects, each of which can be effectively controlled to yield an accurate, low-cost, humidity sensor. A 50 MHz YZ-cut lithium niobate SAW sensor coated with polyXIO has been demonstrated as a humidity sensor with a range of 0%–100% RH and a hysteresis on the order of 5%. In addition, a 767 MHz AT-cut quartz SH-SAW sensor coated with a plasma-modified hexamethyldisiloxane (HMDSO) has recently been demonstrated as a humidity sensor, with a sensitivity of 1.4 ppm % RH and a 5% hysteresis.

Vapor Chemical Sensor-Coated and Uncoated.

Chemical vapor sensors based on SAW devices were first reported in 1979. Most of them rely on the mass sensitivity of the detector, in conjunction with a chemically selective coating that absorbs the vapors of interest and results in an increased mass loading of the device. As with the temperature-compensated pressure sensors, one SAW is used as a reference, effectively minimizing the effects of temperature variations. Several design considerations must be satisfied when selecting and applying the chemically absorptive coating. Ideally, the coating is completely reversible, meaning that it will absorb and then completely desorb the vapor when purged with clean air. The rate at which the coating absorbs and desorbs should be fairly quick, <1 s, for instance. The coating should be robust enough to withstand corrosive vapors. It should be selective, absorbing only very specific vapors while rejecting others. The coating must operate over a realistic temperature range. It should be stable, reproducible, and sensitive. And finally, its thickness and uniformity are very important. When several SAW sensors, each with a unique chemically specific coating, are configured as an array, each will have a different output when exposed to a given vapor. Pattern recognition software allows a diverse list of volatile organic compounds thus to be detected and identified, yielding a very powerful chemical analyzer. TSM resonators have also successfully been used for chemical vapor sensing but they are significantly less sensitive than their SAW counterparts. In addition, SAW chemical vapor sensors have been made without coatings.

This method uses a gas chromatograph column to separate the chemical vapor components, and a temperature-controlled SAW that condenses the vapor and measures the corresponding mass loading.

In one embodiment of the present invention, a Vapor Chemical Sensor (Coated and Uncoated) sensor can be used to detect the response signals 38, 44, 74, or 68 and, more specifically, to detect a chemical threat to the Homeland Security.

Biosensor.

Similar to chemical vapor sensors, biosensors detect chemicals, but in liquids rather than vapors. As noted earlier, the SAW device is a poor choice for this application, as the vertical component of the propagating wave will be suppressed by the liquid. Biosensors have been fabricated using the TSM resonator, SH-APM, and SH-SAW sensors. Of all the known acoustic sensors for liquid sensing, the Love wave sensor, a special class of the shear-horizontal SAW, has the highest sensitivity. To make a Love wave sensor, a waveguide coating is placed on a SH-SAW device such that the energy of the shear horizontal waves is focused in that coating. A biorecognition coating is then placed on the waveguide coating, forming the complete biosensor. Successful detection of anti-goat IgG in the concentration range of 3 ($10^{-8}$–$10^{-6}$) moles using a 110 MHz YZ-cut SH-SAW with a polymer Love wave guide coating has been achieved.

In one embodiment of the present invention, a biosensor can be used to detect the response signals 38, 44, 74, or 68 and, more specifically, to detect a biological threat to the Homeland Security.

Acoustic wave sensors are extremely versatile devices that are just beginning to realize their commercial potential. They are competitively priced, inherently rugged, very sensitive, and intrinsically reliable, and can be interrogated passively and wirelessly. Wireless sensors are beneficial when monitoring parameters on moving objects, such as tire pressure on cars or torque on shafts. Sensors that require no operating power are highly desirable for remote monitoring of chemical vapors, moisture, and temperature. Other applications include measuring force, acceleration, shock, angular rate, viscosity, displacement, and flow, in addition to film characterization. The sensors also have an acoustoelectric sensitivity, allowing the detection of pH levels, ionic contaminants, and electric fields. Surface acoustic wave sensors have proved to be the most sensitive in general as a result of their larger energy density on the surface. For liquid sensing, a special class of shear-horizontal surface acoustic wave sensors called Love wave sensors proved to be the most sensitive. Much work is continuing in developing these sensors for future applications.

For example, Columbia Research Laboratories, Inc., located at Woodlyn. PA, 19094, USA, manufactures the Model VM-300 Vibration Meter, a general-purpose vibration measuring instrument for periodic routine vibration checks of industrial machinery and general field use where portability and ease of use are required. This sensor can be used for the purposes of the present invention to implement the 2-D internal acoustic sensor 34 of FIG. 2, the 3-D internal acoustic sensor 64 of FIG. 3, the 2-D external acoustic sensor 40 of FIG. 2, and the 3-D external acoustic sensor 70 of FIG. 3, or components of the gird/array of the acoustic sensor pads.

Referring still to FIG. 1, in one embodiment of the present invention, the block 12 for substantially continuously probing each cargo container further comprises an internal radio sensor (not shown) configured to detect an RF signal emanating from at least one container, wherein an emanated RF signal is selected from the group consisting of: {a cell phone signal; a radio signal; and a pseudolite signal}.

Referring still to FIG. 1, in one embodiment of the present invention, the block 12 for substantially continuously probing each cargo container further comprises an external radio sensor (not shown) configured to detect at least one RF signal incoming into at least one container, wherein an incoming RF signal is selected from the group consisting of: {a cell phone signal; a radio signal; a satellite signal; and a pseudolite signal}.

Referring still to FIG. 1, in one embodiment of the present invention, the block 16 for processing each detected threat signature to determine a likelihood of at least one threat to become a threat to the homeland security further comprises, a block (C1) for selecting an array of statistically significant threat signatures, and (C2) a block for substantially continuously processing the array of selected statistically significant detected threat signatures in order to determine the likelihood of each threat.

Figure 4:
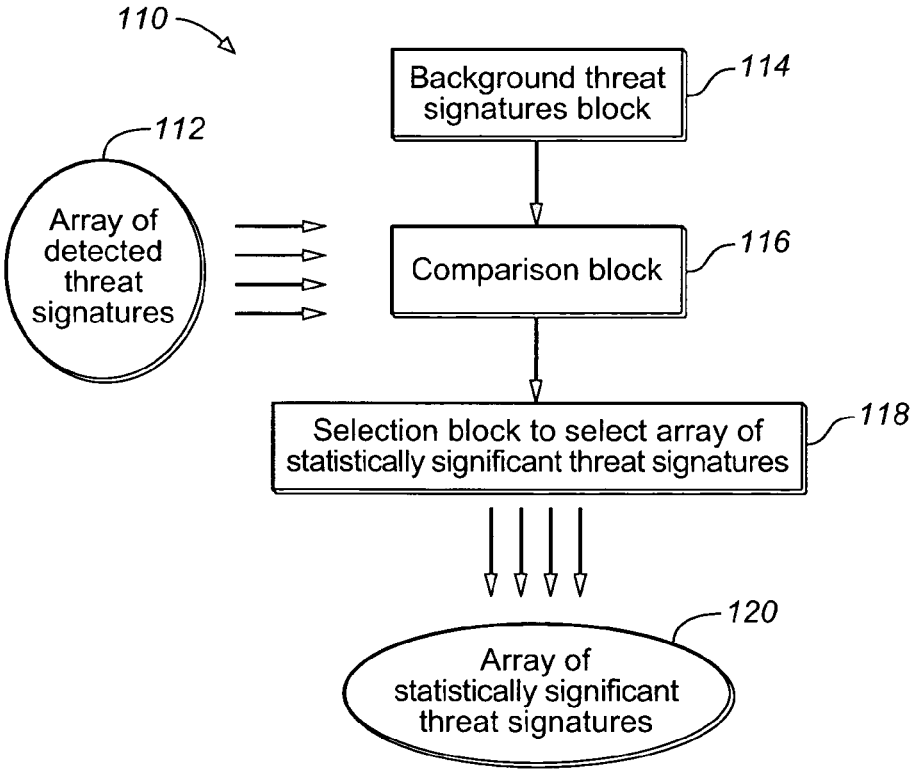
FIG. 4 illustrates the block for selecting the array of statistically significant detected threat signatures for the purposes of the present invention.

In one embodiment of the present invention, FIG. 4 illustrates the block (C1) for selecting the array of statistically significant detected threat signatures comprising: a block 114 for measuring a background threat signature distribution in a threat-free environment; a block 116 for comparing each detected threat signature signal with the background threat signature distribution; and a block 118 for selecting the detected threat signature to be a part of the array 120 of the statistically significant detected threat signatures, if deviation of each selected threat signature signal from the background threat signature distribution is statistically significant.

Figure 5:
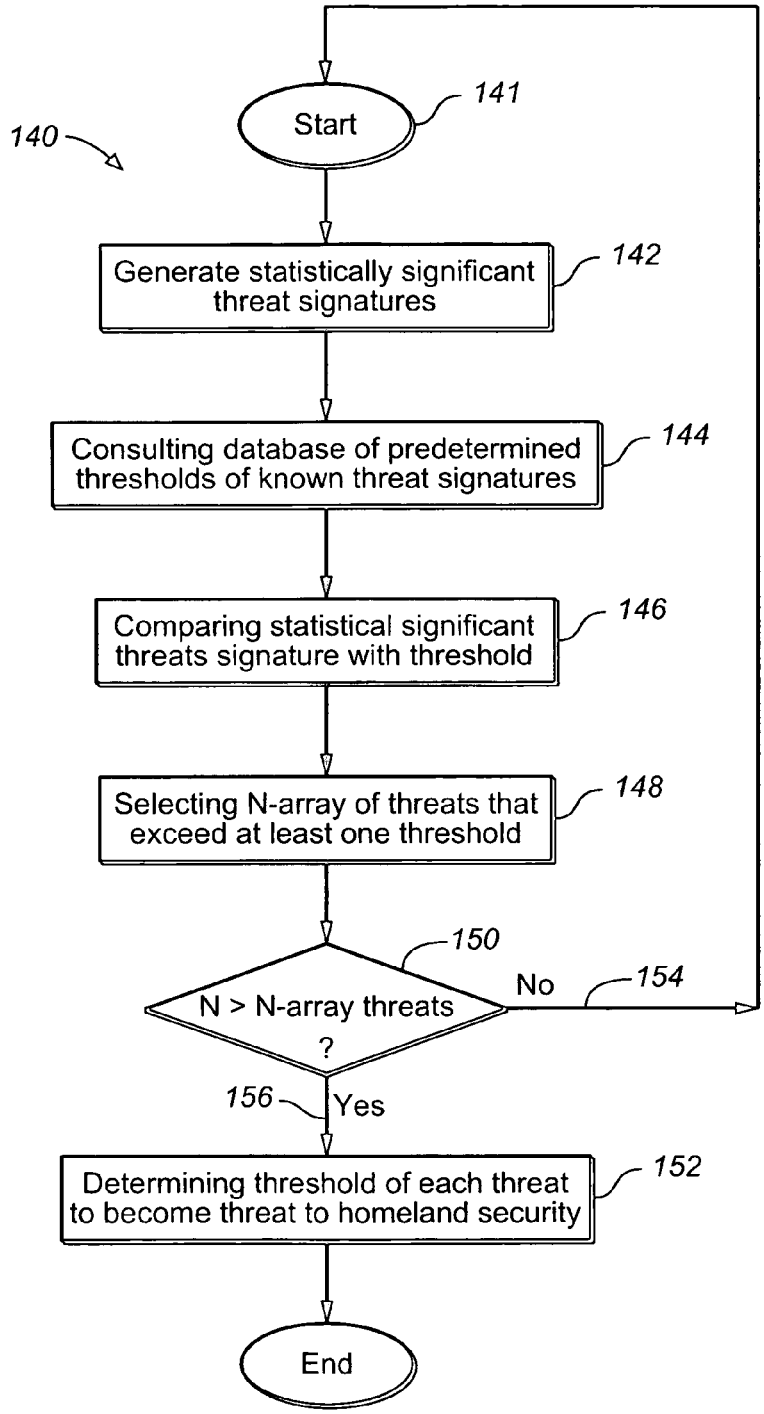
FIG. 5 depicts the block for substantially continuously processing the array of the selected statistically significant threat signatures in order to determine the likelihood of each threat to become a threat to the Homeland Security.

FIG. 5 depicts, in one embodiment of the present invention, the block (C2) for substantially continuously processing the array of the selected statistically significant threat signatures in order to determine the likelihood of each threat in more details.

More specifically, the block for substantially continuously processing the array of the selected statistically significant threat signatures in order to determine the likelihood of each threat further comprises: a block 142 for generating a statistically significant threat signal corresponding to each detected threat signature having the statistically significant deviation from the background threat signature distribution; a block 144 for consulting a database of predetermined thresholds associated with a plurality of known threat signatures; a block 146 for comparing each statistically significant threat signature signal with the at least one predetermined threshold associated with the plurality of known threat signatures; a block 148 for selecting each statistically significant threat signature signal that exceeds at least one predetermined threshold associated with the plurality of known threat signatures into an N-array of threat signatures; a test block 150 to determine if the number of threat signatures selected into an N-array is greater than $N_{array_thershold}$; and a block 152 for determining the likelihood of each threat generating at least one statistically significant threat signature signal exceeding at least one predetermined threshold to become a threat to the homeland security.

Referring still to FIG. 5, to decrease the low false negative rate and to decrease the high false positive rate, we use the idea os sensor fusion—we need a certain number N of statistically significant threat signature signals to exceed at least one predetermined threshold associated with the plurality of known threat signatures to be greater than $N_{array_thershold}$, before one should start the threat identification process in block 152 of FIG. 5.

The U.S. Pat. No. 5,051,723, issued to Long et al. and incorporated by reference herein in its entirety, discloses a self-contained theft and vandalism deterrent system for equipment security that includes a number of sensors for detecting conditions to which an alarm is responsive. The analog signals from the sensors are serially delivered by a multiplexer circuit when they are then directed to a network for conversion to digital signals. The digital signals are delivered to a microprocessor where the signals are evaluated to determine if an alarm condition exists. The sending means include sound and vibration detectors for monitoring the ambient envelope. The microprocessor includes built in reprogramming and comparator circuits for varying the levels at which a given condition will trigger an alarm response.

In one embodiment of the present invention, the block 16 (of FIG. 1) for processing the detected threat signals can be implemented by using the developed in the '723 patent sensor ambient envelope processor.

More specifically, in one embodiment of the present invention, the flow chart 140 (of FIG. 5) comprises an Ambient Envelope Sensor-fusion (AES) platform of '723 patent that has a transparent open bus structure and accepts multiple sensor data stream inputs, interprets and interpolates the sensor data and outputs alarms, warnings and authorized requested data. In this embodiment, the AES platform provides for data fusion which uses multiple sets of data streams to significantly improve performance as compared with the situation when the same sensors are used separately. The AES platform can include a history record to develop an ambient envelop within each container.

EXAMPLE

Detection of a Person Hidden Inside a Cargo Container. $N \geqq N_{array_thershold}=2$.

Assume that the primary detection modality is chosen to be an acoustic sensor, and the secondary detection modality is chosen to be an electromagnetic sensor. In this scenario, an acoustic detector continuously monitors the cargo container for abnormal sounds. It is trained to recognize the normal sounds of a cargo vessel: thrumming engines, pounding waves, banging containers, shifting contents, etc. Operating close to its threshold of detection, it frequently "hears" scrapping noises that could be associated with human activity. Without other evidence, the perceived threat would be wrong an unacceptable percentage of the time. However, whenever such a "potential" threat is detected, there is one more detector to be consulted with-an electromagnetic sensor. The electromagnetic sensor also continuously monitors the cargo container for abnormal activity. For instance, an LED, or array of LEDs, that emit in the near infrared (NIR), can be used. This wavelength is invisible to humans but can be detected by a suitable infrared camera. An NIR source and an NIR camera would be able to continuously monitor (i.e., probe) the interior of a sealed (i.e., impenetrably dark) cargo container. The signature would be any unusual changes in the "scene"; i.e., motion associated with a human presence, as opposed to shifting cargo. In the absence of a threat simultaneously reported by both the acoustic sensor and the electromagnetic sensor, the apparatus 10 (of FIG. 1) of the present invention simply updates its data base and resets itself, thereby minimizing the false positive rate while maintaining a high degree of sensitivity to threats. However, if both detectors are detecting the threat signatures to be above their corresponding thresholds, the threat inside container is identified as a hidden human intruder.

Clearly, there are tradeoffs to be made in terms of the number of sensors-modalities to be used, the choice of modalities, the sophistication (think cost) of the measurements, the perceived likelihood of a threat, the acceptable false positive rate, the acceptable false negative rate, etc.

Referring still to FIG. 1, in one embodiment of the present invention, the block 18 for identifying at least one threat to the homeland security further comprises a radio frequency identification (RFID) tag (not shown) configured to identify at least one container that includes at least one threat to the homeland security. In this embodiment of the present invention, each container is equipped with at least one (RFID) tag.

In another embodiment of the present invention, the block 18 for identifying at least one threat to the homeland security further comprises a passive radio frequency identification (RFID) tag (not shown) configured to identify at least one container that includes at least one threat to the homeland security. In this embodiment of the present invention, each container is equipped with at least one passive (RFID) tag.

Referring still to FIG. 1, in one embodiment of the present invention, the block 20 for eliminating at least one threat to the homeland security further comprises an emergency beacon (not shown) configured to alert maritime traffic of the hazard to navigation. In one embodiment of the present invention, the block 20 for eliminating at least one threat to the homeland security further comprises a jamming device (not shown) configured to suppress an RF signal emanating from or incoming to at least one container, wherein the RF signal is selected from the group consisting of: {a radio signal; a cell phone signal; a satellite signal; and a pseudolite signal}.

Referring still to FIG. 1, in one embodiment of the present invention, the block 20 for eliminating at least one threat to the homeland security further comprises a robotic block configured to eliminate at least one detected threat to the homeland security. One can envision each cargo ship in the future being equipped with a robotic device that upon receiving a control signal from the RFID tag from the specific container that was deemed to have a high likelihood of being a threat to the Homeland security, moves towards that specific container and takes necessary steps to eliminate this specific threat.

One aspect of the present invention is directed to a method of active detection of at least one threat to the homeland security. Each such threat is either hidden inside at least one cargo container before transit, or is placed inside at least one cargo container while in transit. Each such threat while interacting with its surrounding generates a unique threat signature.

In one embodiment, the method of the present invention comprises the following steps (not shown): (A) substantially continuously probing each cargo container; (B) detecting at least one threat signature; (C) processing each detected threat signature to determine a likelihood of at least one threat to become a threat to the homeland security; (D) identifying at least one container that includes at least one threat to the homeland security; and (E) eliminating at least one threat to the homeland security while in transit.

In one embodiment of the present invention, wherein at least one container is equipped with at least one active electromagnetic sensor, the step (A) further comprises the step (A1) of using each active electromagnetic sensor to substantially continuously probe at least one cargo container by generating a 2-D internal probing signal, wherein at least one response signal is indicative of at least one threat signature. In another embodiment of the present invention, wherein at least one container is equipped with at least one active electromagnetic sensor, the step (A) further comprises the step (A2) of using each active electromagnetic sensor to substantially continuously probe at least one cargo container by generating a 3-D internal probing signal, wherein at least one response signal is indicative of at least one threat signature.

In one embodiment of the present invention, wherein each container is selected from the group consisting of: {a container equipped with at least one active electromagnetic sensor; and a "rogue" container that is not equipped with at least one active electromagnetic sensor}, the step (A) further comprises the step (A3) of using each active electromagnetic sensor to substantially continuously probe at least one cargo container by generating a 2-D external probing signal, wherein at least one response signal is indicative of at least one threat signature. In another embodiment of the present invention, wherein each container is selected from the group consisting of: {a container equipped with at least one active electromagnetic sensor; and a "rogue" container that is not equipped with at least one active electromagnetic sensor}, the step (A) further comprises the step (A4) of using each active electromagnetic sensor to substantially continuously probe at least one cargo container by generating a 3-D external probing signal, wherein at least one response signal is indicative of at least one threat signature.

In one embodiment of the present invention, wherein the cargo ship is equipped with a grid/array of electromagnetic sensor pads, the step (A) further comprises the step (A5) of using the grid/array of electromagnetic sensor pads to substantially continuously probe at least one cargo container, wherein at least one response signal is indicative of at least one threat signature.

In one embodiment of the present invention, the step (A5) further comprises the step (A5, 1) of using the grid/array of electromagnetic sensor pads to substantially continuously ping each cargo container, wherein at least one response signal is indicative of at least one threat signature. In another embodiment of the present invention, the step (A5) further comprises the step (A5, 2) of using the grid/array of electromagnetic sensor pads to form an electromagnetic beam signal, wherein the electromagnetic beam signal is used to ping at least one cargo container, and wherein at least one response signal is indicative of at least one threat signature.

In one embodiment of the present invention, wherein at least one container is equipped with at least one active acoustic sensor, the step (A) further comprises the step (A6) of using each active acoustic sensor to substantially continuously probe at least one cargo container by generating a 2-D internal acoustic probing signal, wherein at least one response signal is indicative of at least one threat signature.

In another embodiment of the present invention, wherein at least one container is equipped with at least one active acoustic sensor, the step (A) further comprises the step (A7) of using each active acoustic sensor to substantially continuously probe at least one cargo container by generating a 3-D internal acoustic probing signal, wherein at least one response signal is indicative of at least one threat signature.

In one embodiment of the present invention, wherein each container is selected from the group consisting of: {a container equipped with at least one active acoustic sensor; and a "rogue" container that is not equipped with at least one active acoustic sensor}, the step (A) further comprises the step (A8) of using each active acoustic sensor to substantially continuously probe at least one cargo container by generating a 2-D external acoustic probing signal, wherein at least one response signal is indicative of at least one threat signature. In another embodiment of the present invention, wherein each container is selected from the group consisting of: {a container equipped with at least one active acoustic sensor; and a "rogue" container that is not equipped with at least one active acoustic sensor}, the step (A) further comprises the step (A9) of using each active acoustic sensor to substantially continuously probe at least one cargo container by generating a 3-D external acoustic probing signal, wherein at least one response signal is indicative of at least one threat signature.

In one embodiment of the present invention, wherein the cargo ship is equipped with a grid/array of acoustic sensor pads, the step (A) further comprises the step (A10) of using the grid/array of acoustic sensor pads to substantially continuously probe at least one cargo container, wherein at least one response signal is indicative of at least one threat signature.

In one embodiment of the present invention, the step (A10) further comprises the step (A10, 1) of using the grid/array of acoustic sensor pads to substantially continuously ping each cargo container, wherein at least one response signal is indicative of at least one threat signature. In another embodiment of the present invention, the step (A10) further comprises the step (A10, 2) of using the grid/array of acoustic sensor pads to form an acoustic beam signal, wherein the narrowly formed acoustic beam signal is used to ping at least one cargo container, and wherein at least one response signal is indicative of at least one threat signature.

In one embodiment of the present invention, the step (A) further comprises the step (A11) of using a radio sensor to detect an RF signal emanating from at least one container, wherein each emanated RF signal is selected from the group consisting of: {a cell phone signal; a radio signal; and a pseudolite signal}. In another embodiment of the present invention, the step (A) further comprises the step (A11) of using a radio sensor to detect at least one RF signal incoming into at least one container; wherein each incoming RF signal is selected from the group consisting of: {a cell phone signal; a radio signal; a satellite signal; and a pseudolite signal}.

In one embodiment of the present invention, the step (B) of detecting at least one threat signature further comprises the step (B1) of detecting each threat signature by analyzing at least one response signal.

In one embodiment of the present invention, the step (C) of processing each detected threat signature further comprises the following steps (not shown): (C1) selecting an array of statistically significant threat signatures; and (C2) substantially continuously processing the array of selected statistically significant detected threat signatures in order to determine the likelihood of each threat.

In one embodiment of the present invention, the step (D) further comprises the step (D1) of using a radio frequency identification (RFID) tag to identify at least one container that includes at least one threat to the homeland security.

In one embodiment of the present invention, the step (D) further comprises the step (D2) of using a passive radio frequency identification (RFID) tag to identify at least one container that includes at least one threat to the homeland security.

In one embodiment of the present invention, the step (E) further comprises the step (E1) of launching an emergency beacon to alert maritime traffic of the hazard to navigation.

In one embodiment of the present invention, the step (E) further comprises the step (E2) of using robotic block to eliminate at least one detected threat to the homeland security.

In one embodiment of the present invention, the step (E) further comprises the step (E3) of using a jamming device to suppress an RF signal emanating from or incoming to at least one container, wherein the RF signal is selected from the group consisting of: {a radio signal; a cell phone signal; a satellite signal; and a pseudolite signal}.

The foregoing description of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. Therefore, it is intended that the scope of the invention be defined by the claims appended hereto and their equivalents, rather than by the foregoing description. All changes which come within the meaning and range of equivalency of the claims are to be embraced within their scope.

What is claimed is:

1. A method of active detection of at least one threat to the homeland security; each said threat either being hidden inside at least one cargo container before transit, or being placed inside at least one cargo container while in transit; each said threat while interacting with its surrounding generates a unique threat signature; said method comprising the steps of:

(A) substantially continuously probing each said cargo container;

(B) detecting at least one said threat signature;

(C) processing each said detected threat signature to determine a likelihood of at least one said threat to become a threat to the homeland security;

(D) identifying at least one said container that includes said threat to the homeland security;

and (E) using robotic means to eliminate at least one said detected threat to the homeland security.

2. A method of active detection of at least one threat to the homeland seurity; each said threat either being hidden inside at least one cargo container before transit or being placed inside at least one cargo container while in transit; each said threat while interacting with its surrounding generates a unique threat signature; said method comprising the steps of:

(A) substantially continuously probing each said cargo container;

(B) detecting at least one said threat signature;

(C) processing each said detected threat signature to determine a likelihood of at least one said threat to become a threat to the homeland security;

(D) identifying at least one said container that includes said threat to the homeland security;

and (E) using a jamming device to suppress an RF signal emanating from or incoming to at least one container, wherein said RF signal is selected from the group consisting of a radio signal; a cell phone signal; a satellite signal; and a pseudolite signal.

3. An apparatus for active detection of at least one threat to the homeland security; each said threat either being hidden inside at least one cargo container before transit, or being placed inside at least one cargo container while in transit; each said threat while interacting with its surrounding generates a unique threat signature; said apparatus comprising:

(A) a means for substantially continuously probing each said cargo container;

(B) a means for detecting at least one said threat signature;

(C1) a means for selecting an array of statistically significant threat signatures;

(C2, 1) a means for generating a statistically significant threat signal corresponding to each said detected threat signature having said statistically significant deviation from said background threat signature distribution;

(C2, 2) a means for consulting a database of predetermined thresholds associated with a plurality of known threat signatures;

(C2, 3) a means for comparing each said statistically significant threat signature signal with said at least one predetermined threshold associated with said plurality of known threat signatures;

(C2, 4) a means for selecting each said statistically significant threat signature signal that exceeds at least one said predetermined threshold associated with said plurality of known threat signatures into an N-array of threat signatures;

(C2, 5) a means for determining said likelihood of each said threat generating at least one said statistically significant threat signature signal exceeding at least one said predetermined threshold;

and (D) a means for identifying at least one said container that includes said threat to the homeland security.

4. An apparatus for active detection of at least one threat to the homeland security; each said threat either being hidden inside at least one cargo container before transit, or being placed inside at least one cargo container while in transit; each said threat while interacting with its surrounding generates a unique threat signature; said apparatus comprising:

(A) a means for substantially continuously probing each said cargo container;

(B) a means for detecting at least one said threat signature;

(C) a means for processing each said detected threat signature to determine a likelihood of at least one said threat to become a threat to the homeland security;

(D) a means for identifying at least one said container that includes said threat to the homeland security, and (E) a robotic means configured to eliminate at least one said detected threat to the homeland security.

5. An apparatus for active detection of at least one threat to the homeland security; each said threat either being hidden inside at least one cargo container before transit, or being placed inside at least one cargo container while in transit; each said threat while interacting with its surrounding generates a unique threat signature; said apparatus comprising:

(A) a means for substantially continuously probing each said cargo container;

(B) a means for detecting at least one said threat signature;

(C) a means for processing each said detected threat signature to determine a likelihood of at least one said threat to become a threat to the homeland security;

(D) a means for identifying at least one said container that includes said threat to the homeland security;

and (E) a jamming device configured to suppress an RF signal emanating from or incoming to at least one container, wherein said RF signal is selected from the group consisting of a radio signal; a cell phone signal; a satellite signal; and a pseudolite signal.

* * * * *